US005262274A

United States Patent [19]

Katoh

[11] Patent Number: 5,262,274

[45] Date of Patent: Nov. 16, 1993

[54] SILVER HALIDE PHOTOGRAPHIC MATERIAL

[75] Inventor: Kazunobu Katoh, Kanagawa, Japan

[73] Assignee: Fuji Photo Film Co., Ltd., Kanagawa, Japan

[21] Appl. No.: 876,386

[22] Filed: Apr. 30, 1992

[30] Foreign Application Priority Data

May 2, 1991 [JP] Japan ..... 3-128214

[51] Int. Cl.[5] ..... G03C 1/06

[52] U.S. Cl. ..... 430/264; 430/223; 430/265; 430/598; 430/957; 430/544

[58] Field of Search ..... 430/264, 598, 223, 957, 430/265, 544

[56] References Cited

U.S. PATENT DOCUMENTS 5,155,006 10/1992 Goto et al. ..... 430/264

*Primary Examiner*—Charles L. Bowers, Jr.
*Assistant Examiner*—Thorl Chea
*Attorney, Agent, or Firm*—Sughrue, Mion, Zinn, Macpeak & Seas

[57] ABSTRACT

Disclosed is a novel silver halide photographic material which comprises at least one light-sensitive silver halide emulsion layer on a support. The light-sensitive layer or another hydrophilic colloidal layer contains a compound represented by the following general formula (1):

(1)

wherein X represents a hydroxy, amino or sulfonamide group; $A_1$ and $A_2$ each represents a hydrogen atom, an alkylsulfonyl group, an arylsulfonyl group or an acyl group, with the proviso that at least one of $A_1$ and $A_2$ is a hydrogen atom; $G_1$ represents —CO—, —COCO—, —CS—, —C(=$NG_2R_3$)—, —SO—, —$SO_2$— or —P(O)($G_2R_3$)—; $G_2$ represents a mere bond, —O—, —S— or —N($R_3$)—; $R_1$ represents a hydrogen atom, an amino group, a sulfonamide group, a halogen atom, a hydroxyl group, an alkoxy group or an alkyl group; L represents a divalent linking group; n represents an integer 0 or 1; $R_2$ represents an aliphatic, aromatic or heterocyclic group; Time represents a divalent linking group; t represents an integer 0 or 1; $R_3$ represents a hydrogen atom or a group recited in the definition of $R_2$; and PUG represents a photographically useful group. A second silver halide emulsion or another hydrophilic colloid layer adjacent thereto contains a nucleating agent.

8 Claims, No Drawings

SILVER HALIDE PHOTOGRAPHIC MATERIAL

FIELD OF THE INVENTION

The present invention relates to a silver halide photographic material and a process for the formation of an ultrahigh contrast negative image using that silver halide photographic material. More particularly, the present invention relates to an ultrahigh contrast negative silver halide photographic material suitable for photomechanical processes.

BACKGROUND OF THE INVENTION

In the field of photomechanical processes, there has been a need for photographic light-sensitive materials which are excellent in original reproducibility, and which are suitable for stable processing solutions or simplied replenishment methods, to cope with the diversification and complexty of printed matters.

In particular, line originals to be subjected to the process of picture taking normally comprise photocomposed letters, handwritten letters, illustrations, dot photographs, etc. Thus, line originals are normally formed of a mixture of images having different densities and line widths. Therefore, there has been a need for plate-making cameras, photographic light-sensitive materials, and image formation methods which give excellent reproduction of these originals.

On the other hand, enlargement or reduction of dot photograph is widely performed to make plates for catalogues or large-sized posters. In the dot enlargement process, the number of lines per inch area is reduced, giving an unsharp picture. In the dot reduction process, the number of lines per inch is increased, giving a fine picture. Accordingly, an image formation method has been desired which provides a wider latitude to maintain excellent reproducibility of dot gradation.

The light source for plate-making cameras is a halogen or xenon lamp. In order to be sufficiently sensitive to these light sources, light-sensitive materials are normally subjected to orthochromatic sensitization. However, it has been found that the photographic light-sensitive materials thus orthochromatically sensitized are more susceptible to the effects of chromatic aberration of the lens which can deteriorate picture quality, particularly when a xenon lamp is used.

In a known method for meeting the demand for wide a latitude, a lithographic silver halide photographic material comprising silver bromochloride (at least having a silver chloride content of 50% or more) is processed with a hydroquinone developer having an extremely low effective concentration of sulfurous ions (normally 0.1 mol/l or less) so that one can obtain line originals or dot images having a high contrast and a blackened density in which the image portion and the nonimage portion are clearly distinguishabl from each other. However, this method is disadvantageous in that the development is extremely unstable to air oxidation due to the low sulfurous acid concentration of the developer. In order to stabilize the activity of the developer, various efforts and measures must be made. Furthermore, this method provides a remarkably low processing speed, lowering the working efficiency.

Thus, an image formation method has been desired which comprises development with a processing solution having an excellent storage stability to provide ultrahigh contrast while eliminating the instability in the formation of images associated with the above mentioned development method (i.e., a lithographic development system). In the systems as proposed in U.S. Pat. Nos. 4,166,742, 4,168,977, 4,221,857, 4,224,401, 4,243,739, 4,272,606, and 4,311,781, a surface latent image type silver halide photographic material comprising a specific acylhydrazine compound is processed with a developer having a pH value of 11.0 to 12.3, containing 0.15 mol/l or more of a sulfurous acid preservative, and having an excellent storage stability, to form an ultrahigh contrast negative image having $\gamma$ of more than 10. This new image formation system is characterized in that it can use silver bromoiodide and silver bromochloroiodide while the prior art ultrahigh contrast image formation systems can use only silver bromochloride having a high silver chloride content.

The above-mentioned image formation system is excellent in dot sharpness, processing stability and rapidity, and original reproducibility. In order to cope with the recent diversification of printed matters, a system has been desired which provides greater stability and higher original reproducibility.

A light-sensitive material comprising a redox compound which undergoes oxidation to release a photographically useful group is disclosed in JP-A-61-213847 (the term "JP-A" as used herein means an "unexamined published Japanese patent application"), 62-260153, 64-88451 and 64-72140, and U.S. Pat. No. 4,684,604. However, in an ultrahigh contrast processing system using a hydrazine derivative, these redox compounds need to be used in large amounts to provide excellent line original and dot image reproducibility. Since an inhibitor which has been released upon development partially effuses, it will gradually accumulate in the developer as a large amount of a light-sensitive material containing these redox compounds is processed. Accordingly, when development is effected with such a fatigued developer, an ultrahigh contrast can hardly be provided or a reduced sensitivity results. In particular, if an automatic developing machine is also used for light-sensitive materials for picture taking, contact light-sensitive materials, scanner light-sensitive materials or photographic light-sensitive materials as well as light-sensitive materials containing these redox compounds, photographically adverse effects will occur on these light-sensitive materials.

Therefore, the amount of these redox compounds to be used is limited, making it impossible to accomplish satisfactory results. Furthermore, such a system can be applied to a closed system in which a light-sensitive material and a developer are restricted within a narrow range. Thus, the known systems leave much to be desired.

SUMMARY OF THE INVENTION

It is therefore an object of the present invention to provide a silver halide photographic material which exhibits an excellent storage stability and contains a novel compound that rapidly releases a development inhibitor.

It is another object of the present invention to provide a compound which can be used in a small amount to accomplish a great effect in providing excellent image reproducibility in an ultrahigh contrast light-sensitive material system.

It is a further object of the present invention to provide a photographic light-sensitive material for plate making which can be processed with a developer having a high stability to obtain a high contrast image.

It is a still further object of the present invention to provide a photographic light-sensitive material for plate making having a wide gradation from an ultrahigh contrast photographic light-sensitive material containing a hydrazine nucleating agent.

These and other objects of the present invention are accomplished with a silver halid photographic material which comprises at least one light-sensitive silver halide emulsion layer on a support. The light-sensitive layer or another hydrophilic colloidal layer contains a compound represented by the following general formula (1):

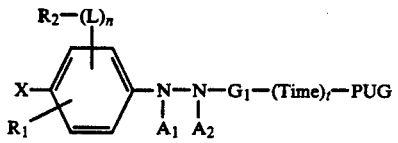

(1)

In general formula (1), X represents a hydroxy, amino or sulfonamide group. The amino and sulfonamide groups may further contain substituents.

$A_1$ and $A_2$ each represents a hydrogen atom, an alkylsulfonyl group, an arylsulfonyl group or an acyl group. At least one of $A_1$ and $A_2$ is a hydrogen atom. $G_1$ represents —CO—, —COCO—, —CS—, —C(=$NG_2R_3$)—, —SO—, —$SO_2$— or —P(O)($G_2R_3$)—. $G_2$ represents a mere bond, —O—, —S— or —N($R_3$)—. Time represents a divalent linking group. The suffix t represents an integer 0 or 1. $R_3$ represents a hydrogen atom or a group selected from the groups in the definition of $R_2$ below.

$R_1$ represents a hydrogen atom, an amino group, a sulfonamide group, a halogen atom, a hydroxyl group, an alkoxy group or an alkyl group. The amino and sulfonamide groups may further contain substituents.

L represents a divalent linking group. The suffix n represents an integer 0 or 1. $R_2$ represents an aliphatic, aromatic or heterocyclic group. PUG represents a photographically useful group.

DETAILED DESCRIPTION OF THE INVENTION

The compound of general formula (1) will be further described hereinafter.

In general formula (1), the aliphatic group represented by $R_2$ is preferably a $C_{1-30}$, particularly a $C_{1-20}$ straight-chain, branched or cyclic alkyl group. This alkyl group may contain substituents.

In general formula (1), the aromatic group represented by $R_2$ is a monocyclic or bicyclic aryl group or an unsaturated heterocyclic group. The unsaturated heterocyclic group may be condensed with an aryl group to form a heteroaryl group.

Examples of such a aryl or heteroaryl group include benzene ring, naphthalene ring, a pyridine ring, a quinoline ring, and an isoquinoline ring. Particularly preferred among these heteroaryl groups are those containing benzene rings.

Particularly preferred among the groups represented by $R_2$ is an aryl group.

The aryl group or unsaturated heterocyclic group represented by $R_2$ may be substituted by substituents. Typical examples of such substituents include an alkyl group, an aralkyl group, an alkenyl group, an alkinyl group, an alkoxy group, an aryl group, a substituted amino group, a ureide group, a urethane group, an aryloxy group, a sulfamoyl group, a carbamoyl group, an alkylthio group, an arylthio group, a sulfonyl group, a sulfinyl group, a hydroxyl group, a halogen atom, a cyano group, a sulfo group, an aryloxycarbonyl group, an acyl group, an alkoxycarbonyl group, an acyloxy group, a carbonamide group, a sulfonamide group, a carboxyl group, and a phosphoric amide. Preferred examples of the substituents include straight-chain, branched or cyclic alkyl groups (preferably containing 1 to 20 carbon atoms), aralkyl groups (preferably containing 7 to 30 carbon atoms), alkoxy groups (preferably containing 1 to 30 carbon atoms), substituted amino groups (preferably amino group containing a $C_{1-30}$ alkyl group), acylamino groups (preferably containing 2 to 40 carbon atoms), sulfonamide groups (preferably 1 to 40 carbon atoms), ureide groups (preferably containing 1 to 40 carbon atoms), and phosphoric amide groups (preferably 1 to 40 carbon atoms).

In general formula (1), $G_1$ is preferably —CO— or —$SO_2$—, particularly —CO—.

Both $A_1$ and $A_2$ are preferably hydrogen atoms.

In general formula (1), Time represents a divalent linking group which serves to control timing. The divalent linking group represented by Time is a group which causes PUG to be released from Time-PUG which has been released from the hydrazine portion through a reaction of one or more stages.

Examples of the divalent linking group represented by Time include linking groups which undergo an intramolecular ring closure reaction of a p-nitrophenoxy derivative to release Ind as described in U.S. Pat. No. 4,248,962 (JP-A-54-145135), linking groups which undergo an intramolecular ring closure reaction after ring cleavage to release Ind as described in U.S. Pat. Nos. 4,310,612 (JP-A-55-53330) and 4,358,525, linking groups which undergo an intramolecular ring closure reaction of a carboxyl group in succinic monoester or analogous compound thereof to release Ind while producing an acid anhydride as described in U.S. Pat. Nos. 4,330,617, 4,446,216 and 4,483,919, and JP-A-59-121328, linking groups which undergo an electron migration via a double bond by which an aryloxy group or heterocyclic oxy group is conjugated to release Ind while producing quinomonomethane or analogous compounds thereof as described in U.S. Pat. Nos. 4,409,323, 4,421,845, and 4,416,977 (JP-A-57-135944), Research Disclosure No. 21,228 (December 1981), and JP-A-58-209736 and JP-A-58-209738, linking groups which undergo an electron migration in a portion having a nitrogen-containing heterocyclic enamine structure to release Ind from the γ-position of enamine as described in U.S. Pat. No. 4,420,554 (JP-A-57-136640), and JP-A-57-135945, JP-A-57-188035, JP-A-58-98728, and JP-A-58-209737, linking groups which undergo an electron migration to a carbonyl group conjugated with a nitrogen atom in a nitrogen-containing heterocyclic group to produce an oxy group which undergoes an intramolecular ring closure reaction to release Ind as described in JP-A-57-56837, linking groups which release Ind with the formation of an aldehyde as described in U.S. Pat. No. 4,146,396 (JP-A-52-90932), and JP-A-59-93442, JP-A-59-75475, JP-JP-A-60-249148, and JP-A-60-249149, linking groups which release Ind with the decarboxylation of a carboxyl group as described in JP-A-51-146828, JP-A-57-179842 and JP-A-59-104641, linking groups having a —O—COOCRaRb—Ind (in which Ra and Rb each represents a monovalent group) structure which produce Ind with the formation of an aldehyde following decarboxylation, linking groups which release Ind with the formation of isocyanate as described in JP-A-60-7429, and linking groups which undergo a coupling reaction with the oxidation product of a color developing agent to release Ind as described in U.S. Pat. No. 4,438,193.

Specific examples of the divalent linking group represented by Time are mentioned in JP-A-61-236549, JP-A-1-269936, and Japanese Patent Application No. 2-93487.

X represents a hydroxyl group, a substituted or unsubstituted amino group, or a substituted or unsubstituted sulfonamide group. The hydroxyl group may be in the form of ester of an organic acid which produces a hydroxyl group upon development of the photographic material.

The substituent to the amino or sulfonamide group is preferably an alkyl or aryl group containing 10 or less carbon atoms which may form a nitrogen or sulfur-containig ring. Other examples of atoms constituting such a ring include carbon and oxygen.

$R_1$ represents a hydrogen atom, a substituted or unsubstituted amino group, a halogen atom, a hydroxyl group, an alkoxy group, an alkyl group or a substituted or unsubstituted sulfonamide group.

The substituent for the amino group is preferably an alkyl group containing 10 or less carbon atoms.

The alkoxy group is preferably an alkoxy group containing 10 or less carbon atoms.

The alkyl group is preferably an alkyl group containing 10 or less carbon atoms.

The substituent for the sulfonamide group is preferably an alkyl or aryl group containing 10 or less carbon atoms.

Examples of PUG include various photographically useful groups such as a development inhibitor, a development accelerator, a color toner, a bleach accelerator, a color image-forming agent and a fixation accelerator.

Particularly preferred among these photographically useful groups is a development inhibitor.

A particularly preferred development inhibitor contains hetero atoms via which it is bonded to the other portions of general formula (1), either to Time when $t=1$ or to $G_1$ when $t=0$.

Examples of known development inhibitors are described in T. H. James, *The Theory of Photographic Processes*, 4th ed., 1977, Macmillan, pp. 396–399, and Japanese Patent Application No. 2-93487, pp. 56–69.

These development inhibitors may contain substituents.

Examples of useful substituents for the development inhibitors include a mercapto group, a nitro group, a carboxyl group, a sulfo group, a phosphono group, a hydroxyl group, an alkyl group, an aralkyl group, an alkenyl group, an alkinyl group, an aryl group, an alkoxy group, an aryloxy group, an amino group, an acylamino group, a sulfonylamino group, a ureide group, a urethane group, a sulfamoyl group, a carbamoyl group, an alkylthio group, an arylthio group, a sulfonyl group, a sulfinyl group, a halogen atom, a cyano group, an aryloxycarbonyl group, an acyl group, an alkoxycarbonyl group, an acyloxy group, a carbonamide group, a sulfonamide group, and a phosphonamide group.

The development inhibitor represented by PUG in the present invention is preferably a compound which inhibits nucleation infectious development.

The concept of nucleation infectious development is a new development chemistry used in image formation systems such as Fuji Film Grandex System (Fuji Photo Film Co., Ltd.) and Kodak Ultratec System (Eastman Kodak Co., Ltd.).

As described in *Nihon Shashin Gakkaishi*, vol. 52, No. 5, pp. 390–394 (1989), and *Journal of Photographic Science*, vol. 35, page 162 (1987), development chemistry consists of (i) a development process in which silver halide grains which have been exposed to light are processed with an ordinary developing agent to produce an oxidation product of the developing agent and that oxidation product then undergoes cross oxidation with a nucleating agent to form a nucleation active seed, and (ii) a nucleation infectious development in which surrounding unexposed silver halide grains and weakly exposed silver halide grains are processed with the nucleation active seed.

Accordingly, the entire development process consists of an ordinary development process and a nucleation development process. Therefore, besides ordinary development inhibitors which have been heretofore known as development inhibitors, compounds which inhibit the nucleation infectious development process can exert an inhibiting effect. The latter is hereinafter referred to as "nucleation development inhibitor".

The development inhibitor represented by PUG in the present invention is preferably a nucleation development inhibitor. Compound which can serve as nucleation development inhibitors include the development inhibitors which have been heretofore known can exert such an effect. Particularly useful examples of such compounds include compounds containing at least one nitro or nitroso group, compounds containing nitrogen-containing heterocyclic skeletons such as pyridine, pyrazine, quinoline, quinoxaline and phenazine, (particularly compounds containing a 6-membered nitrogen-containing heterocyclic group aromatic ring skeleton), compounds containing an N-halogen bond, quinones, tetrazoliums, amine oxides, azoxy compounds, and coordination compounds having oxidative effect.

Particularly useful among these compounds are compounds containing a nitro group and compounds having pyridine skeleton.

These nucleation development inhibitors may contain substituents. By properly selecting the properties of these substituents, e.g., electrophilicity, hydrophobicity, hydrophilicity, chargeability and adsorptivity to silver halide, various other characteristics, the degree of development inhibition and diffusibility of these nucleation development inhibitors can be controlled.

Examples of useful substituents include those described with reference to the ordinary development inhibitors.

Specific examples of these useful nucleation development inhibitors in the present invention are described in Japanese Patent Application Nos. 2-258927 and 2-258928. Furthermore, these useful nucleation development inhibitors are described as Ind in Japanese Patent Application Nos. 2-258929 and 3-15648.

Other useful examples of nucleation development inhibitors include anionically chargeable groups and compounds adsorbable to silver halide grains containing a dissociable group which can undergo dissociation in a developer to be anionically charged.

In general formula (1), $R_2$ or Time may contain a ballast group commonly incorporated in immobile photographic additives such as a coupler or a group which accelerates the adsorption of the compound represented by general formula (1) onto silver halide grains.

The ballast group is an organic group which provides the compound represented by general formula (1) with an enough molecular weight to prevent the compound from substantially diffusing into other layers or into the processing solution. The ballast group consists of a combination of an alkyl group, an aryl group, a heterocyclic group, an ether group, a thioether group, an amide group, a ureide group, a urethane group, a sulfonamide group, etc. Such a ballast group is preferably one containing substituted benzene rings, particularly a ballast group containing branched alkyl-substituted benzene rings.

Specific examples of the group which accelerates adsorption onto silver halide grains include cyclic thioamide groups such as 4-thiazoline-2-thione, 4-imidazoline-2-thione, 2-thiohydantoin, rhodanine, thiobarbituric acid, tetrazoline-5-thione, 1,2,4-triazoline-3-thione, 1,3,4-oxazoline-2-thione, benzimidazoline-2-thione, benzoxazoline-2-thione, benzothiazoline-2-thione, thiotriazine, and 1,3-imidazoline-2-thione, chain thioamide groups, aliphatic mercapto groups, aromatic mercapto groups, heterocyclic mercapto groups (if the atom adjacent to the carbon atom to which —SH group is bonded is a nitrogen atom, the heterocyclic mercapto groups have the same meaning as the cyclic thioamide groups which are tautomeric thereto; specific examples of these heterocyclic mercapto groups include those exemplified above), groups containing a disulfide bond, nitrogen-containing heterocyclic groups containing 5 or 6 members consisting of a combination of nitrogen, oxygen, sulfur and carbon, such as benzotriazole, triazole, tetrazole, indazole, benzimidazole, imidazole, benzothiazole, thiazole, thiazoline, benzoxazole, oxazole, oxazoline, thiadiazole, oxathiazole, triazine, and azaindene, and heterocyclic quaternary salts such as benzimidazolinium.

These adsorption accelerating groups may be further substituted by suitable substituents.

Examples of such substituents include those described with reference to $R_2$.

Specific examples of the compound which can be used in the present invention are set forth below, but the present invention should not be construed as being limited thereto:

1-1

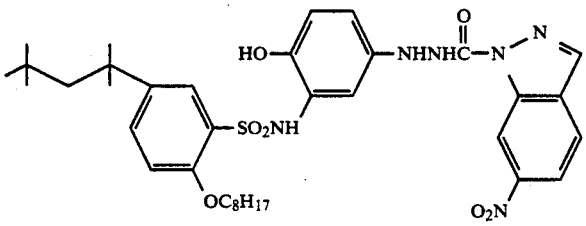

1-2

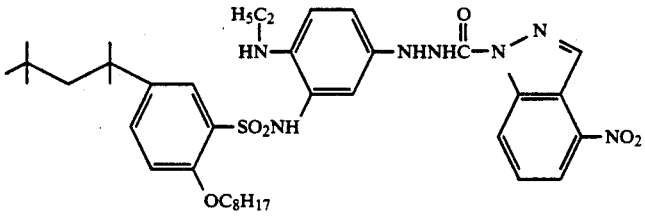

1-3

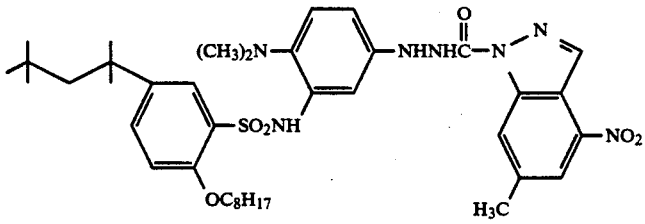

1-4

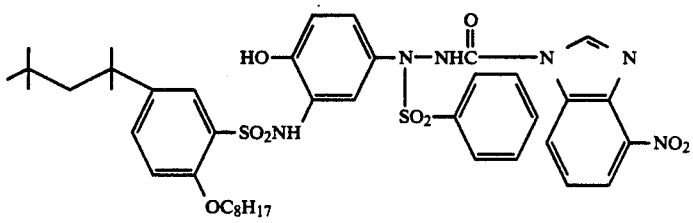

-continued
1-5
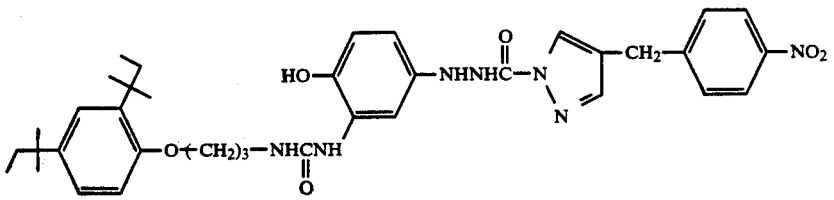
1-6
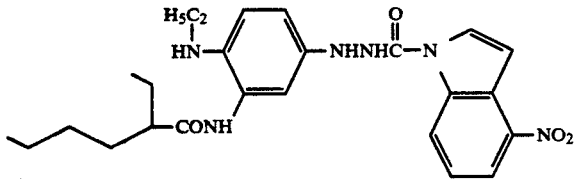
1-7
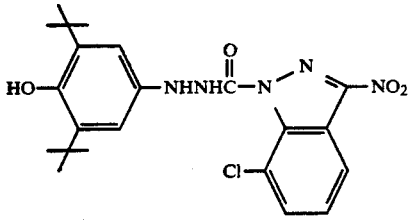
1-8
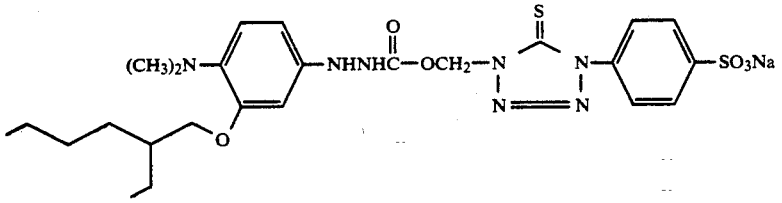
1-9
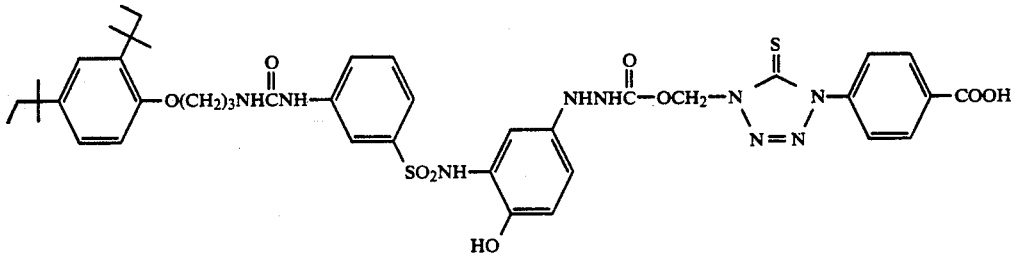
1-10
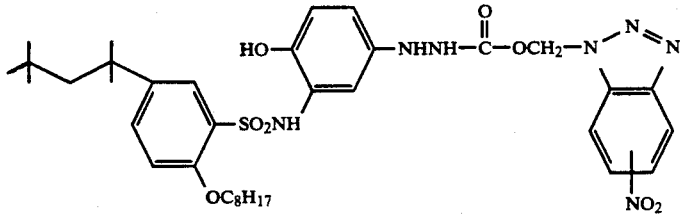
1-11
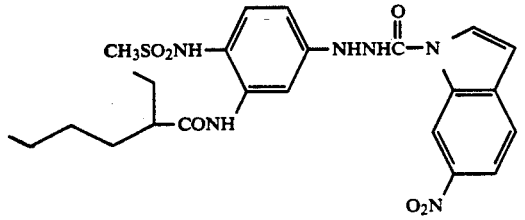

-continued
1-12
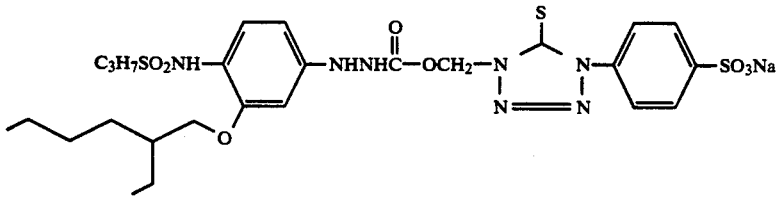
1-13
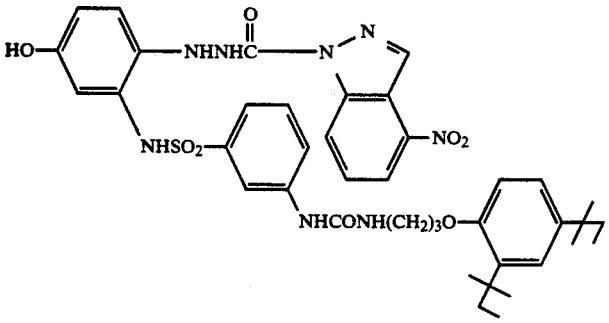
1-14
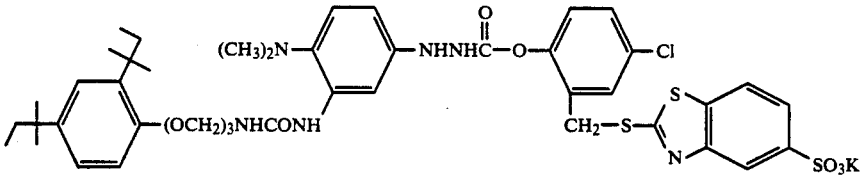
1-15
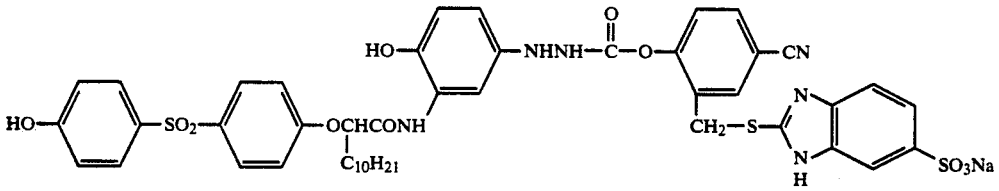
1-16
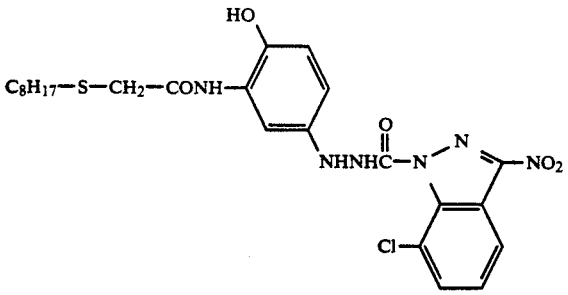
1-17
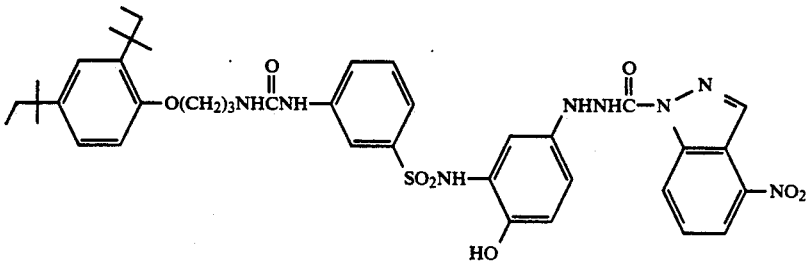

-continued 1-18

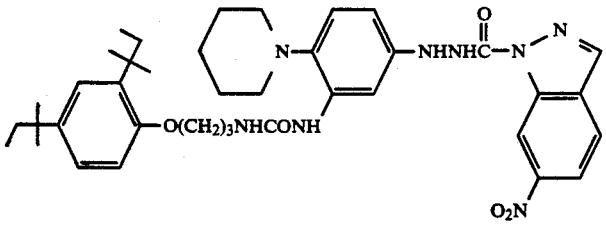

1-19

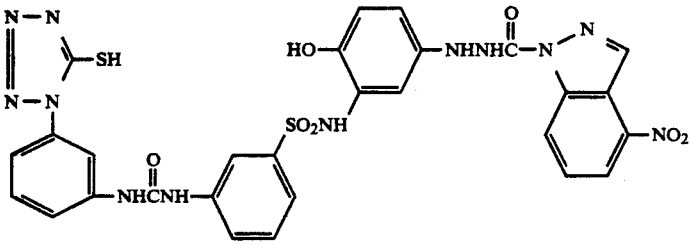

1-20

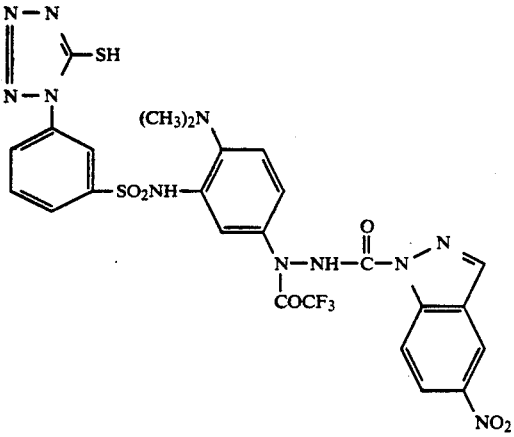

Specific examples of the process for the synthesis of the compound represented by formula (1) are described in JP-A-61-213847, and JP-A-62-260153, U.S. Pat. No. 4,684,604, and Japanese Patent Application Nos. 2-62337, 2-64717, and 1-290563.

The compound of formula (1) can be used in an amount of $1\times10^{-6}$ to $5\times10^{-2}$ mol, preferably $1\times10^{-5}$ to $1\times10^{-2}$ mol, per mol of silver halide.

The compound of formula (1) can be used in the form of solution in a proper water-miscible organic solvent such as alcohol (e.g., methanol, ethanol, propanol, fluorinated alcohol), ketone (e.g., acetone, methyl ethyl ketone), dimethylformamide, dimethylsulfoxide, or methyl cellosolve.

A well known emulsion dispersion method can be used to dissolve the compound in an oil such as dibutyl phthalate, tricresyl phosphate, glyceryl triacetate and diethyl phthalate or auxiliary solvent such as ethyl acetate and cyclohexanone to mechanically prepare an emulsion dispersion. Alternatively, a solid dispersion method can be used to disperse the powdered compound of formula (1) in water by means of a ball mill or colloid mill or by an ultrasonic apparatus.

The compound of formula (1) may be incorporated into a silver halide emulsion layer or another hydrophilic colloidal layer. Alternatively, the compound of formula (1) may be incorporated into each of several silver halide emulsion layers. Several examples of configurations will be set forth below, but the present invention should not be construed as being limited thereto.

Configuration Example 1) This configuration comprises comprises a silver halide emulsion layer containing a compound of the present invention and a protective layer provided on a support. The emulsion layer or protective layer may contain a nucleating agent.

Configuration Example 2) This configuration comprises a first silver halide emulsion layer and a second silver halide emulsion layer provided in that order on a support. The first silver halide emulsion layer or an adjacent hydrophilic colloidal layer thereto contains a nucleating agent. The second silver halide emulsion layer or an adjacent hydrophilic colloidal layer, contains a compound of formula (1). In this configuation, the hydrophilic colloid layer adjacent to the first emulsion layer is not the same as the hydrophilic colloid layer adjacent to the second emulsion layer.

Configuration Example 3) This configuration is the same as Configuration Example 2) except that the order of arrangement of emulsion layers is reversed.

In Configuration Examples 2) and 3), an interlayer containing gelatin or a synthetic polymer (e.g., polyvinyl acetate, polyvinyl alcohol) may be provided between the two light-sensitive emulsion layers.

Configuration Example 4) This configuration comprises a silver halide emulsion containing a nucleating agent on a support. A hydrophilic colloidal layer containing a compound of formula (1) is provided on the silver halide emulsion layer or between the support and the silver halide emulsion layer.

Particularly preferred among these configuration examples are Configuration Example 2) or 3).

The nucleating agent in the present invention is preferably a compound represented by the following general formula (2):

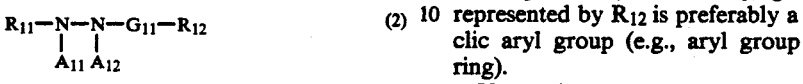

(2)

wherein $R_{11}$ represents an aliphatic group or aromatic group; $R_{12}$ represents a hydrogen atom, an alkyl, an aryl, an alkoxy, an aryloxy, an amino or hydrazine group; Gu represents —CO—, —$SO_2$—, —SO—, —P(O)$R_{13}$—, —COCO—, a thiocarbonyl or iminomethylene group; $A_{11}$ and $A_{12}$ each represents a hydrogen atom or one of $A_{11}$ and $A_{12}$ represents a hydrogen atom and the other represents a substituted or unsubstituted alkylsulfonyl group, substituted or unsubstituted arylsulfonyl group or substituted or unsubstituted acyl group; and $R_{13}$ is one of the groups represented by $R_{12}$ and may differ from $R_{12}$.

In general formula (2), the aliphatic group represented by $R_{11}$ is preferably a $C_{1-30}$, particularly $C_{1-20}$ straight-chain, branched or cyclic alkyl group. This alkyl group may contain substituents.

In general formula (2), the aromatic group represented by $R_{11}$ is a monocyclic or bicyclic aryl group or unsaturated heterocyclic group. The heterocyclic group may be condensed with an aryl group.

Preferred among the groups represented by $R_{11}$ is an aryl group, particularly one containing a benzene ring.

The aliphatic group or aromatic group represented by $R_{11}$ may be substituted by substituents. Typical examples of such substituents include an alkyl group, an aralkyl group, an alkenyl group, an alkinyl group, an alkoxy group, an aryl group, a substituted amino group, a ureide group, a urethane group, an aryloxy group, a sulfamoyl group, a carbamoyl group, an alkylthio group, an arylthio group, an alkylsulfonyl group, an arylsulfonyl group, an alkylsulfinyl group, an arylsulfinyl group, a hydroxyl group, a halogen atom, a cyano group, a sulfo group, an aryloxycarbonyl group, an acyl group, an alkoxycarbonyl group, an acyloxy group, a carbonamide group, a sulfonamide group, a carboxyl group, a phosphoric amide group, a diacylamino group, an imide group, and an $R_{14}$—NHCO—N($R_{15}$)—CO— group (in which $R_{14}$ and $R_{15}$ are selected from the substitutent groups for $R_2$ in formual (1) and may be different from each other). Preferred among these substituents are alkyl groups (preferably containing 1 to 20 carbon atoms), aralkyl groups (preferably containing 7 to 30 carbon atoms), alkoxy groups (preferably containing 1 to 20 carbon atoms), substituted amino groups (preferably amino group substituted by a $C_{1-20}$ alkyl group), acylamino groups (preferably containing 2 to 30 carbon atoms), sulfonamide groups (preferably containing 1 to 30 carbon atoms), ureide groups (preferably containing 1 to 30 carbon atoms), and phosphoric amide groups (preferably containing 1 to 30 carbon atoms) These groups may be further substituted by substituents.

In general formula (2), the alkyl group represented by $R_{12}$ is preferably a $C_{1-4}$ alkyl group. The aryl group represented by $R_{12}$ is preferably a monocyclic or bicyclic aryl group (e.g., aryl group containing benzene ring).

If $G_{11}$ is a —CO— group, preferred among the groups represented by $R_{12}$ are a hydrogen atom, an alkyl group (e.g., methyl, trifluoromethyl, 3-hydroxypropyl, 3-methanesulfonamidepropyl, phenylsulfonylmethyl), an aralkyl group (e.g., o-hydroxybenzyl), and an aryl group (e.g., phenyl, 3,5-dichlorophenyl, o-methanesulfonamidophenyl, 4-methanesulfonylphenyl, 2-hydroxymethylphenyl). Particularly preferred among these groups is a hydrogen atom.

$R_{12}$ may be substituted by substituents. Examples of such substituents include those described with reference to $R_{11}$.

In general formula (2), $G_{11}$ is most preferably a —CO— group.

$R_{12}$ may cause a cyclization reaction by which the $G_{11}$—$R_{12}$ portion is separated from the rest of the molecule to produce a cyclic structure containing the —$G_{11}$—$R_{12}$ portion. Examples of such a group represented by $R_{12}$ are described in JP-A-63-29751.

$A_{11}$ and $A_{12}$ each is most preferably a hydrogen atom.

In general formula (2), $R_{11}$ or $R_{12}$ may contain a ballast group or polymer commonly incorporated in immobile photographic additives such as couplers. Such a ballast group is a group containing 8 or more carbon atoms and is relatively inert to photographic properties. The ballast group can be selected from an alkyl group, an alkoxy group, a phenyl group, an alkylphenyl group, a phenoxy group, an alkylphenoxy group, etc. Examples of the above-mentioned polymer include those disclosed in JP-A-1-100530.

In general formula (2), $R_{11}$ or $R_{12}$ may contain a group which intensifies the adsorption of the compound onto the surface of silver halide grains. Examples of such an adsorption promoting group include a thiourea group, a heterocyclic thioamide group, a mercaptoheterocyclic group, and a triazole group as disclosed in U.S. Pat. Nos. 4,385,108, and 4,459,347, JP-A-59-195233, JP-A-59-200231, JP-A-59-201045, JP-A-59-201046, JP-A-59-201047,JP-A-59-201048,JP-A-59-201049, JP-A-61-170733, JP-A-61-270744, JP-A-62-948, JP-A-63-234244, JP-A-63-234245, and JP-A-63-234246.

Specific examples of the compounds represented by general formula (2) are set forth below, but the present invention should not be construed as being limited thereto:

(2-1)

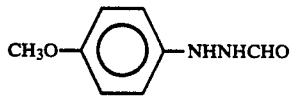

-continued
(2-2)
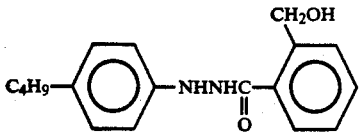
(2-3)
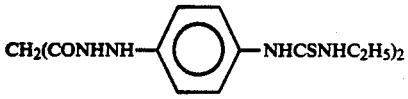
(2-4)
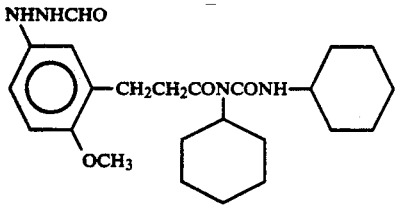
(2-5)
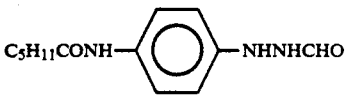
(2-6)
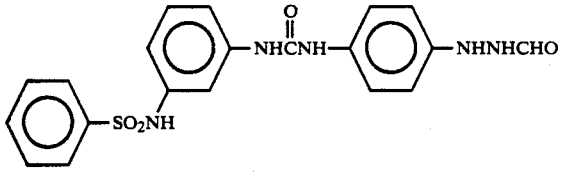
(2-7)
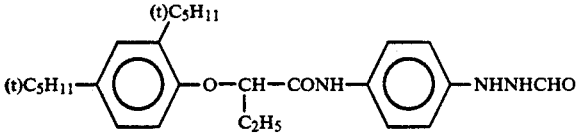
(2-8)
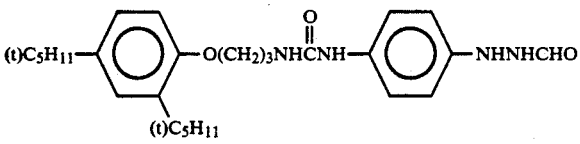
(2-9)
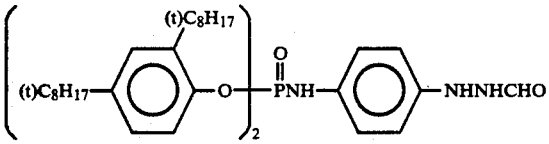
(2-10)
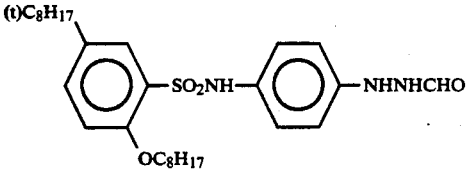
(2-11)
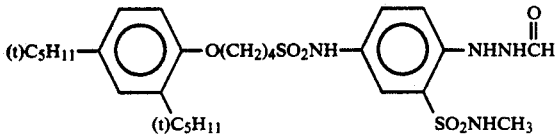

-continued
(2-12)
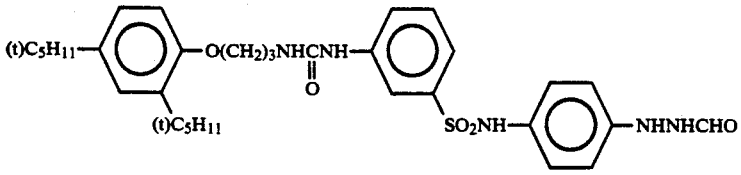
(2-13)
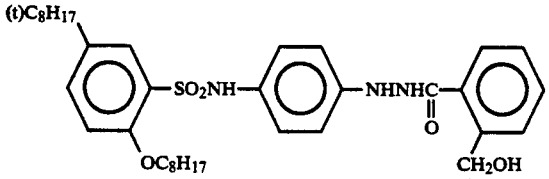
(2-14)
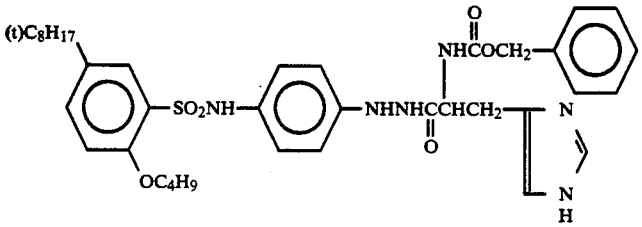
(2-15)
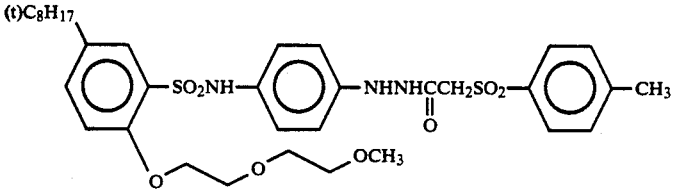
(2-16)
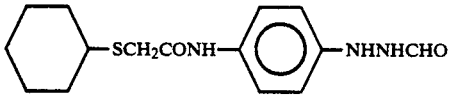
(2-17)
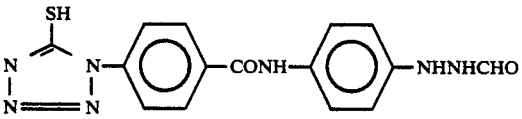
(2-18)
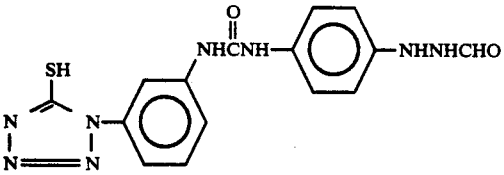
(2-19)
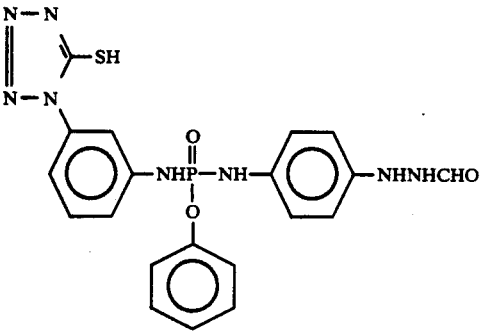

-continued
(2-20)
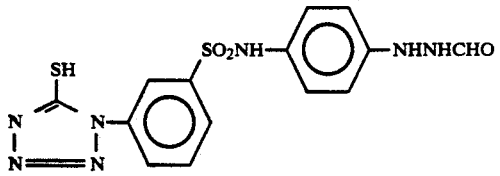
(2-21)
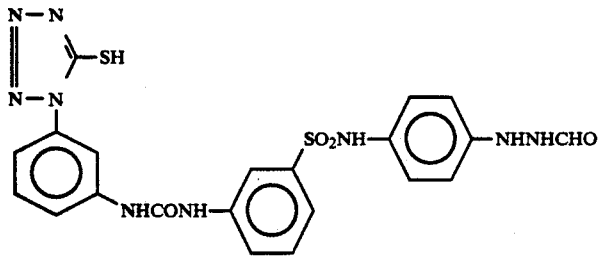
(2-22)
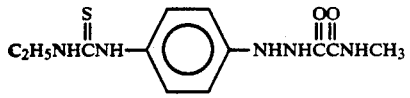
(2-23)
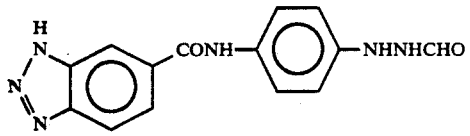
(2-24)
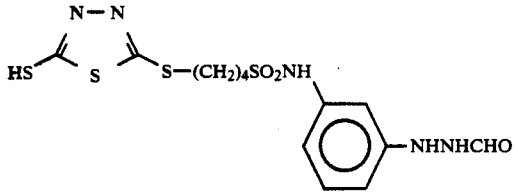
(2-25)
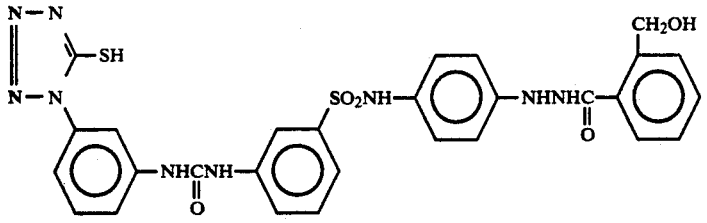
(2-26)
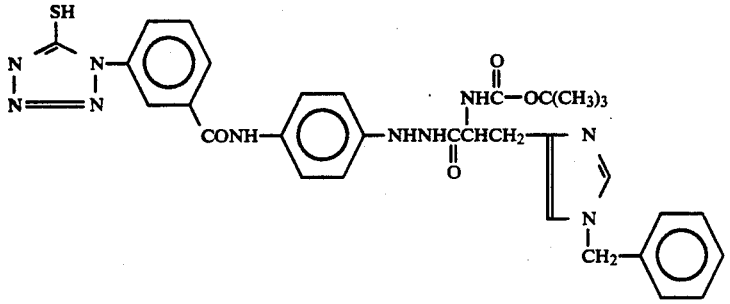

-continued (2-27)

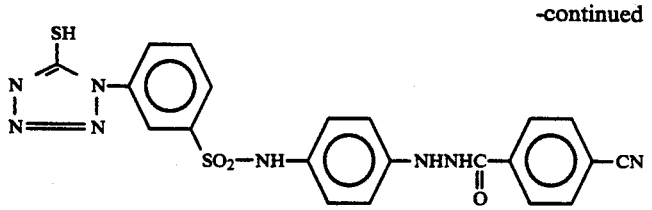

Other examples of the hydrazine derivatives which can be used in the present invention include those described in Research Disclosure Item 23516 (November 1983, page 346), literatures cited therein, U.S. Pat. Nos. 4,080,207, 4,269,929, 4,276,364, 4,278,748, 4,385,108, 4,459,347, 4,560,638, 4,478,928, and 4,686,167, British Patent 2,011,391B, European Patents 217,310, and 356,898, JP-A-60-179734, 62-270948, 63-29751, 61-170733, 61-270744, 62-270948, 62-178246, 63-32538, 63-104047, 63-121838, 63-129337, 63-223744, 63-234244, 63-234245, 63-234246, 63-294552, 63-306438, 1-100530, 1-105941, 1-105943, 64-10233, 1-90439, 1-276128, 1-280747, 1-283548, 1-283549, 1-285940, 2-2541, 2-139538, and 2-77057, and Japanese Patent Application Nos. 1-18377, 1-18378, 1-18379, 1-15755, 1-16814, 1-40792, 1-42615, 1-42616, 1-123693, and 1-126284.

The amount of the hydrazine derivative to be incorporated as a nucleating agent in the present silver halide photographic material is preferably in the range of $1\times10^{-6}$ to $5\times10^{-2}$ mol, particularly $1\times10^{-5}$ to $2\times10^{-2}$ mol per, mol of silver halide.

The processes for the dissolution and dispersion of these hydrazine nucleating agents are those described with reference to the compounds of general formula (1).

The silver halide emulsion in the present invention may be any composition such as silver chloride, silver bromide, silver bromochloride, silver bromoiodide and silver bromochloroiodide.

The silver halide grains in the present invention are preferably finely divided (e.g., 0.7 μm or less, particularly 0.5 μm or less). The grain size distribution is not basically limited but is preferably monodisperse. The term "monodisperse emulsion" as used herein means an "emulsion comprising grains at least 95% by weight or number of which have a grain size falling within ±40% from the average grain size".

Silver halide grains in the photographic emulsions may have a regular crystal form such as cube and octahedron, or an irregular crystal form such as sphere and tablet, or a combination of these crystal forms.

The silver halide grains may have a phase which is uniform all over the grain or have phases differing from core to shell. Two or more kinds of silver halide emulsions which have been separately prepared may be used in admixture.

In the process for the formation or physical ripening of silver halide grains, cadmium salt, sulfite, zinc salt, thallium salt, rhodium salt, or a complex salt thereof, or iridium salt or complex salt thereof may be use in the system.

The emulsion layers of the present invention or other hydrophilic colloidal layers may comprise a water-soluble dye as a filter dye or for the purpose of inhibiting irradiation or for other purposes. This filter dye can be a dye for further lowering photographic sensitivity, preferably an ultraviolet absorbent having a maximum spectral absorption in the inherent sensitivity range of silver halide or a dye having a substantial light absorption mainly in the range of 350 nm to 600 nm for improving the safety to safelight when treated as a daylight light-sensitive material. These dyes may be preferably incorporated in the emulsion layer or in a layer above the silver halide emulsion layer, i.e., a light-insensitive hydrophilic colloidal layer provided farther from the support than the silver halide emulsion layer, together with a mordant.

Alternatively, as described in International Patent Application Disclosure (WO) 88/04794, European Patent (EP) 0276566A1, and JP-A-63-197943, a water-insoluble dye may be used in the form of a fine dispersion in gelatin.

The amount of such a dye to be incorporated depends on its molar absorptivity and is normally in the range of $10^{-2}$ g/m$^2$ to 1 g/m$^2$, preferably 50 mg/m$^2$ to 500 mg/m$^2$.

Examples of such a dye are further described in JP-A-63-64039.

These dyes may be incorporated in a coating solution for the light-insensitive hydrophilic colloidal layer of the present invention in the form of solution in a proper solvent such as water, alcohol (e.g., methanol, ethanol, propanol), acetone, and methyl cellosolve or a mixture thereof.

Two or more kinds of these dyes may be used in combination.

The dye of the present invention may be used in an amount which allows handling in daylight.

The optimum amount of these dyes is normally in the range of $10^{-3}$ g/m$^2$ to 1 g/m$^2$, preferably $10^{-3}$ g/m$^2$ to 0.5 g/m$^2$.

The binder or protective colloid incorporated in the hydrophilic emulsion may be gelatin. Other hydrophilic colloids may be used. Examples of such hydrophilic colloids which can be used in the present invention include protein such as gelatin derivatives, graft polymers of gelatin with other high molecular compounds, albumine, and casein, saccharide derivatives such as hydroxyethyl cellulose, carboxymethyl cellulose, cellulose ester sulfate, sodium alginate, and starch derivatives, homopolymers or copolymers such as polyvinyl alcohol, polyvinyl alcohol partial acetal, poly-N-vinyl pyrrolidone, polyacrylic acid, polymethacrylic acid, polyacrylamide, polyvinyl imidazole, and polyvinyl pyrazole, and other synthetic hydrophilic high molecular compounds.

The gelatin may be lime-treated gelatin as well as acid-treated gelatin. Furthermore, a hydrolyzate of gelatin and an enzymatic decomposition product of gelatin can be used.

The silver halide emulsion in the present process may or may not be subjected to chemical sensitization. The processes for chemical sensitization of the silver halide emulsion are the known sulfur sensitization processes, reduction sensitization processes and noble metal sensitization processes. These chemical sensitization processes can be used singly or in combination.

The noble metal sensitization process typically used is a gold sensitization process. In the gold sensitization process, a gold compound is used, mainly a gold complex salt. Noble metals other than gold, such as platinum, palladium and rhodium and their complex salts can be included. Specific examples of such compounds are described in U.S. Pat. No. 2,448,060, and British Patent 618,016.

The sulfur sensitizers contained in gelatin include various sulfur compounds such as thiosulfate, thiourea, thiazole and rhodanine, etc.

The reduction sensitizers include stannous salts, amines, formamidinesulfinic acid, silane compounds, etc.

The silver halide emulsion layer to be used in the present invention may comprise a known spectral sensitizing dye.

The light-sensitive material of the present invention may comprise various compounds for the purpose of inhibiting fogging during the preparation, storage or photographic processing of light-sensitive material or stabilizing photographic properties. In particular, many compounds can be used which are known as fog inhibitors or stabilizers. Examples of these fog inhibitors or stabilizers include azoles such as benzothiazolium salt, nitroindazoles, chlorobenzimidazoles, bromobenzimidazoles, mercaptothiazoles, mercaptobenzothiazoles, mercaptothiadiazoles, aminotriazoles, benzothiazoles and nitrobenzotriazoles, mercaptopyrimidines, mercaptotriazines, thioketo compounds such as oxazolinethione, azaindenes such as triazaindenes, tetraazaindenes (particularly 4-hydroxy-substituted (1,3,3a,7)tetraazaindenes), and pentaazaindenes, benzenethiosulfonic acid, benzenesulfinic acid, and benzenesulfonic amide. Preferred among these compounds are benzotriazoles (e.g., 5-methyl-benzotriazole) and nitroindazoles (e.g., 5-nitroindazole). These compounds may be incorporated into the processing solution.

The photographic light-sensitive material of the present invention may contain an inorganic or organic film hardener in the photographic emulsion layer or other hydrophilic colloidal layers. For example, chromium salts (e.g., chromium alum), aldehydes (e.g., glutaraldehyde), N-methylol compounds (e.g., dimethylolurea), dioxane derivatives, activated vinyl compounds (e.g., 1,3,5-triacryloyl-hexahydro-s-triazine, 1,3-vinylsulfonyl-2-propanol), activated halogen compounds (e.g., 2,4-dichloro-6-hydroxy-s-triazine), and mucohalogenic acids may be used either singly or in combination.

The photographic emulsion layer or other hydrophilic colloidal layers in the light-sensitive material prepared according to the present invention may comprise various surface active agents for the purpose of facilitating coating, inhibiting charging, emulsion dispersion and adhesion, and improving smoothness and photographic properties (e.g., accelerating development, improving contrast, sensitization).

Examples of such surface active agents include: nonionic surface active agents such as saponin (steroid series), alkylene oxide derivatives (e.g., polyethylene glycol, polyethylene glycol/polypropylene glycol condensate, polyethylene glycol alkyl ether or polyethylene glycol alkylaryl ether, polyethylene glycol ester, polyethylene glycol sorbitan ester, polyalkylene glycol alkylamine or amide, polyethylene oxide addition product of silicone), glycidol derivatives (e.g., polyglyceride alkenylsuccinate, alkylphenol polyglyceride), aliphatic ester of polyvalent alcohol, or alkylesters of saccharide; anionic surface active agents containing acid groups such as a carboxyl group, a sulfo group, a phospho group, an ester sulfate group or an ester phosphate group (e.g., alkylcarboxylate, alkylsulfonate, alkylbenzenesulfonate, alkylnaphthaleneslfonate, alkylsulfuric ester, alkylphosphoric ester, N-acyl-N-alkyltaurine, sulfosuccinic ester, sulfoalkyl polyoxyethylenealkylphenylether, polyoxyethylenealkylphosphoric ester); amphoteric surface active agents such as amino acid, aminoalkylsulfonic acid, aminoalkylsulfuric or phosphoric ester, alkylbetaine and amine oxide; and cationic surface active agents such as alkylamine salt, aliphatic or aromatic quaternary ammonium salt, heterocyclic quaternary ammonium salt (e.g., pyridinium, imidazolium), and aliphatic or heterocyclic group-containing phosphonium or sulfonium salt.

Surface active agents which are particularly preferred in the present invention are polyalkylene oxides with a molecular weight of 600 or more as described in JP-B-58-9412 (The term "JP-B" as used herein means an "examined published Japanese Patent Publicaion). For the purpose of stabilizing dimensions, a polymer latex such as polyalkyl acrylate may be incorporated into the system.

The development accelerators or nucleation infectious development accelerators suitable for the present invention include the compounds disclosed in JP-A-53-77616, JP-A-54-37732, JP-A-53-137133, JP-A-60-140340 and JP-A-60-14959, as well as various compounds containing nitrogen or sulfur atoms.

Such an accelerator is preferably used in an amount of $1.0\times10^{-3}$ to 0.5 g/m$^2$, preferably preferably $5.0\times10^{-3}$ to 0.1 g/m$^2$, depending on the accelerator. Such an accelerator may be incorporated into a coating solution in the form of a solution in a proper solvent such as water, alcohol (e.g., methanol, ethanol), acetone, dimethylformamide and methyl cellosolve.

Several such additives may be used in combination.

In order to obtain an ultrahigh contrast photograph from the silver halide photographic material of the present invention, a stable developer can be used rather than a conventional infectious developer or a high alkali developer with a pH value of about 13 as described in U.S. Pat. No. 2,419,975.

In other words, the silver halide photographic material of the present invention can be processed with a developer containing sulfite ions as preservatives in an amount of 0.10 mol/l or more, preferably 0.50 mol/l or more, and having a pH value of 9.0 to 12.3, particularly 10.0 to 12.0, to obtain a sufficiently ultrahigh negative image.

The developing agents to be used in the present process are not specifically limited. Various compounds disclosed in T. H. James, *The Theory of the Photographic Process*, 4th ed., Macmillan, pp. 298–327 can be used.

For example, dihydroxybenzenes (e.g., hydroquinone), 3-pyrazolidones (e.g., 1-phenyl-3- pyrazolidone, 4,4-dimethyl-1-phenyl-3-pyrazolidone), aminophenols (e.g.,N-methyl-p-aminophenol), ascorbic acid, hydroxylamines, etc., can be used either singly or in combination.

The silver halide photographic material of the present invention is particularly adapted to be processed with a developer containing dihydroxybenzenes as the main developing agents and 3-pyrazolidones or aminophenols as the auxiliary developing agents. Preferably, the developer contains dihydroxybenzenes in an amount of 0.05 to 0.5 mol/l and 3-pyrazolidones or aminophenols in an amount of 0.06 mol/l or less.

The amines described in U.S. Pat. No. 4,269,929 can be incorporated in the developer to raise the development speed to shorten the development time.

The developer may further contain a pH buffer such as a sulfite, carbonate, borate or phosphate of an alkaline metal, a development inhibitor such as a bromide, an iodide and an organic fog inhibitor (particularly nitroindazoles or benzotriazoles), a fog inhibitor, etc. As necessary, a water softener, a dissolution aid, a color toner, a development accelerator, a surface active agent (particularly the above mentioned polyalkylene oxides), an antifoaming agent, a film hardener, a film silver stain inhibitor (e.g., 2-mercaptobenzimidazolesulfonic acids), etc., may be contained in the developer.

The a fixing agent can be any commonly used composition. The fixing agent can be used a thiosulfate or a thiocyanate as well as an organic sulfur compound known to serve as a fixing agent. The fixing agent to be used with the present invention may contain a water-soluble aluminum compound as a film hardener.

The processing temperature in the present process is normally selected from 18° C. to 50° C.

The photographic processing is preferably effected by means of an automatic developing machine. In accordance with the present process, even if the total processing time between the entrance and exit of the light-sensitive material through the automatic developing machine is set to 90 seconds to 120 seconds, a sufficiently ultrahigh contrast negative gradation photograph can be obtained.

The developer to be used in the present invention may comprise a silver stain inhibitor which is described in JP-A-56-24347. A solubilization agent may be incorporated into the developer such as the compound described in JP-A-61-267759. Further, a pH buffer may be incorporated into the developer such as the compound described in JP-A-60-93433.

If the photographic light-sensitive material of the present invention is a color photographic light-sensitive material, the present photographic light-sensitive material can comprise at least one blue-sensitive layer, at least one green-sensitive layer and at least one red-sensitive layer on a support. The number of silver halide emulsion layers and light-insensitive layers and the order of arrangement of these layers are not specifically limited. In a typical embodiment, the present silver halide photographic material comprises light-sensitive layers consisting of a plurality of silver halide emulsion layers having substantially the same color sensitivity and different light sensitivities on a support. The light-sensitive layers are unit light-sensitive layers having a color sensitivity to any of blue light, green light or red light. In the multi-layer silver halide color photographic material, these unit light-sensitive layers are normally arranged in the order of red-sensitive layer, green-sensitive layer and blue-sensitive layer as viewed from the support. However, the order of arrangement can be optionally reversed depending on the purpose of the application. Alternatively, two unit light-sensitive layers having the same color sensitivity can be arranged with a unit light-sensitive layer having a different color sensitivity interposed therebetween.

Light-insensitive layers such as various interlayers can be provided between these silver halide light-sensitive layers and on the uppermost layer and lowermost layer.

These interlayers can comprise couplers, DIR compounds or the like as described in JP-A-61-43748, JP-A-59-113438, JP-A-59-113440, JP-A-61-20037 and JP-A-61-20038. These interlayers can further comprise a color stain inhibitor as is commonly used.

The plurality of silver halide emulsion layers constituting each unit light-sensitive layer can be preferably in a two-layer structure, i.e., a high sensitivity emulsion layer and a low sensitivity emulsion layer, as described in West German Patent 1,121,470 and British Patent 923,045. In general, these layers are preferably arranged in such an order that the light sensitivity becomes lower towards the support. Furthermore, a light-insensitive layer can be provided between these silver halide emulsion layers. As described in JP-A-57-112751, JP-A-62-200350, JP-A-62-206541, and JP-A-62-206543, a low sensitivity emulsion layer may be provided remote from the support while a high sensitivity emulsion layer can be provided nearer to the support.

In one embodiment of such an arrangement, a low sensitivity blue-sensitive layer (BL), a high sensitivity blue-sensitive layer (BH), a high sensitivity green-sensitive layer (GH), a low sensitivity green-sensitive layer (GL), a high sensitivity red-sensitive layer (RH), and a low sensitivity red-sensitive layer (RL) can be arranged in this order remote from the support. In another embodiment, BH, BL, GL, GH, RH, and RL can be arranged in this order remote from the support. In a further embodiment, BH, BL, GH, GL, RL, and RH can be arranged in this order remote from the support.

As described in JP-B-55-34932, a blue-sensitive layer, GH, RH, GL, and RL can be arranged in this order remote from the support. Alternatively, as described in JP-A-56-25738 and 62-63936, a blue-sensitive layer, GL, RL, GH, and RH can be arranged in his order remote from the support.

As described in JP-B-49-15495, a layer arrangement can be used such that the uppermost layer is a silver halide emulsion layer having the highest sensitivity, the middle layer is a silver halide emulsion layer having a lower sensitivity, and the lowermost layer is a silver halide emulsion layer having a lower sensitivity than that of the middle layer. In such a layer arrangment, the light sensitivity becomes lower towards the support. Even if the layer structure comprises three layers having different light sensitivities, a middle sensitivity emulsion layer, a high sensitivity emulsion layer and a low sensitivity emulsion layer can be arranged in this order remote from the support in a color-sensitive layer as described in JP-A-59-202464.

Alternatively, a high sensitivity emulsion layer, a low sensitivity emulsion layer and a middle sensitivity emulsion layer, or a low sensitivity emulsion layer, a middle sensitivity emulsion layer and a high sensitivity emulsion layer may be arranged in this order. In the case of four-layer structure, too, the arrangement of layers may be similarly altered.

In order to improve color reproducibility, a donor layer (CL) having an interimage effect and a different spectral sensitivity distribution from the main light-sensitive layers such as BL, GL and RL may be provided adjacent or close to these main layers as described in U.S. Pat. Nos. 4,663,271, 4,705,744, and 4,707,436, and JP-A-62-160448 and 63-89580.

As described above, various layer structures and arrangements can be selected depending on the purpose of light-sensitive material.

If the photographic light-sensitive material of the present invention is a color negative film or color reversal film, the suitable silver halide to be incorporated into the photographic emulsion layer in the photographic light-sensitive material of the present invention is silver bromoiodide, silver chloroiodide or silver bromochloroiodide containing silver iodide in an amount of about 30 mol % or less. Particularly suitable is silver bromoiodide containing silver iodide in an amount of about 2 mol % to about 25 mol %.

If the photographic light-sensitive material of the present invention is a color photographic material, the silver halide t be incorporated into the photographic emulsion layer may be preferably silver bromochloride or silver chloride substantially free of silver iodide. The term "substantially free of silver iodide" as used herein means "having a silver iodide content of 1 mol % or less, preferably 0.2 mol % or less". The halogen composition of the silver bromochloride emulsion may be in any proportion of silver bromide to silver chloride. This proportion may be widely selected depending on the purpose. The proportion of silver chloride is preferably 2 mol % or more. A photographic light-sensitive material adapted for rapid processing preferably comprises a so-called highly chlorinated silver emulsion having a high silver chloride content. The silver chloride content in the highly chlorinated emulsion is preferably in the range of 90 mol % or more, more preferably 95 mol % or more. For the purpose of decreasing the replenishment rate of the developer, a substantially pure silver chloride emulsion having a silver chloride content of 98 to 99.9 mol % may be preferably used.

Silver halide grains in the photographic emulsions may be so-called regular grains having a regular crystal form, such as cube, octahedron and tetradecahedron, or those having an irregular crystal form such as sphere and tablet, those having a crystal defect such as a twinning plane, or those having a combination of these crystal forms.

The silver halide grains may be either fine grains of about 0.2 μm or smaller in diameter or giant grains having a projected area diameter of up to about 10 μm, preferably fine grains having a diameter of 0.1 to 0.2 μm. The emulsion may be either a monodisperse emulsion or a polydisperse emulsion.

The preparation of the silver halide photographic emulsion which can be used in the present invention can be accomplished by any suitable method described in Research Disclosure No. 17643 (December 1978), pp. 22–23, "I. Emulsion Preparation and Types", and No. 18716 (November 1979), page 648, Glafkides, "Chimie et Physique Photographique", Paul Montel (1967), G. F. Duffin, *Photographic Emulsion Chemistry*, Focal Press, (1966), and V. L. Zelikman et al., *Making and Coating Photographic Emulsion Focal Press*, (1964).

Furthermore, the monodisperse emulsions described in U.S. Pat. Nos. 3,574,628 and 3,655,394, and British Patent 1,413,748 can be preferably used in the present invention.

Tablet grains having an aspect ratio of about 5 or more can be used in the present invention. The preparation of such tablet grains can be easily accomplished by any suitable method described in Gutoff, *Photograpahic Science and Engineering*, vol. 14, pp. 248–257, (1970), U.S. Pat. Nos. 4,434,226, 4,414,310, 4,433,048, and 4,439,520, and British Patent 2,112,157.

The individual silver halide crystals may have either a homogeneous structure or a heterogeneous structure composed of a core and an outer shell differing in halogen composition, or may have a layered structure. Furthermore, the grains may have fused thereto a silver halide having a different halogen composition or a compound other than silver halide, e.g., silver thiocyanate, lead oxide, etc., by an epitaxial junction. Mixtures of grains having various crystal forms may also be used.

The silver halide emulsion to be used in the present invention is normally subjected to physical ripening, chemical ripening and spectral sensitization. Additives to be used in these steps are described in Research Disclosure Nos. 17643 and 18716 as tabulated below.

In the present invention, light-insensitive finely divided silver halide grains are preferably used. Light-insensitive finely divided silver halide grains are silver halide grains which are not exposed to light upon imagewise exposure for taking of dye images so that they are not substantially developed at development process. Preferably, these silver halide grains are not previously fogged.

These finely divided silver halide grains have a silver bromide content of 0 to 100 mol % and may optionally contain silver chloride and/or silver iodide, preferably 0.5 to 10 mol % of silver iodide.

These finely divided silver halide grains preferably have an average diameter of 0.01 to 0.5 μm, more preferably 0.02 to 0.2 μm, as calculated in terms of diameter of a circle having the same area as the projected area of grain.

These finely divided silver halide grains can be prepared in the same manner as ordinary light-sensitive silver halide grains. In this case, the surface of the silver halide grains needs to be neither optically nor spectrally sensitized. However, prior to the addition of the emulsion to a coating solution, a known additive such as a triazole, azaindene, benzothiazolium or mercapto compound and a zinc compound are preferably added to the emulsion.

Known photographic additives which can be used in the present invention are also described in the above cited two Research Disclosures (RD) as tabulated below:

| Kind of additive | RD17643 | RD18716 |
|---|---|---|
| 1. Chemical sensitizer | p.23 | p. 648 right column (RC) |
| 2. Sensitivity increasing agent | | p. 648 right column (RC) |
| 3. Spectral sensitizer and supersensitizer | pp.23–24 | p. 648 RC–p. 649 RC |
| 4. Brightening agent | p.24 | |
| 5. Antifoggant and stabilizer | pp.24–25 | p. 649 RC |
| 6. Light absorbent, filter dye, and ultraviolet absorbent | pp.25–26 | p. 649 RC–p. p. 650 left column (LC) |
| 7. Stain inhibitor | p.25 RC | p. 650 LC–RC |
| 8. Dye image stabilizer | p.25 | |
| 9. Hardening agent | p.26 | p. 651 LC |
| 10. Binder | p.26 | " |
| 11. Plasticizer and lubricant | p.27 | p. 650 RC |
| 12. Coating aid and surface active agent | pp.26–27 | " |
| 13. Antistatic agent | p.27 | " |

In order to inhibit deterioration in photographic properties due to formaldehyde gas, a compound capable of reacting with and solidifying formaldehyde as disclosed in U.S. Pat. Nos. 4,411,987 and 4,435,503 can be incorporated in the light-sensitive material.

The light-sensitive material to be processed in the present invention can comprise various color couplers. Specific examples of the color couplers are mentioned in the patents mentioned in the above cited Research Disclosure No. 17643, VII-C to G.

Preferred yellow couplers include those described in U.S. Pat. Nos. 3,933,501, 4,022,620, 4,326,024, 4,401,752, 4,248,961, 3,973,968, 4,314,023, and 4,511,649, JP-B-58-10739, British Patents 1,425,020 and 1,476,760, and European Patent 249,473A.

Preferred magenta couplers include 5-pyrazolone compounds and pyrazoloazole compounds. Particularly preferred are those described in U.S. Pat. Nos. 4,310,619, 4,351,897, 3,061,432, 3,725,064, 4,500,630, 4,540,654, and 4,556,630, European Patent 73,636, JP-A-60-33552, 60-43659, 61-72238, 60-35730, 55-118034, and 60-185951, RD Nos. 24220 (June 1984) and 24230 (June 1984), and WO88/04795.

Cyan couplers include naphthol and phenol couplers. Preferred are those described in U.S. Pat. Nos. 4,052,212, 4,146,396, 4,228,233, 4,296,200, 2,369,929, 2,801,171, 2,772,162, 2,895,826, 3,772,002, 3,758,308, 4,334,011, 4,327,173, 3,446,622, 4,333,999, 4,775,616, 4,451,559, 4,427,767, 4,690,889, 4,254,212, and 4,296,199, West German Patent (OLS) No. 3,329,729, European Patents 121,365A, and 249,453A, and JP-A-61-42658.

Colored couplers for correction of unnecessary absorptions of the developed dye preferably include those described in Research Disclosure No. 17643, VII-G, U.S. Pat. Nos. 4,163,670, 4,004,929, and 4,138,258, JP-B-57-39413, and British Patent 1,146,368. Furthermore, the couplers for correction of unnecessary absorption of the developed dye by a fluorescent dye released upon coupling as described in U.S. Pat. No. 4,774,181 and the couplers containing as a separatable group a dye precursor group capable of reacting with a developing agent to form a dye as described in U.S. Pat. No. 4,777,120 can be preferably used.

Couplers capable of forming a developed dye having a certain diffusing property can also be used, such as those described in U.S. Pat. No. 4,366,237, British Patent 2,125,570, European Patent 96,570 and West German Patent Application (OLS) No. 3,234,533.

Further, polymerized color couplers may be used, such as those described in U.S. Pat. Nos. 3,451,820, 4,080,211, 4,367,282, 4,409,320, and 4,576,910, and British Patent 2,102,137.

Compounds capable of releasing a photographically useful group upon coupling can also be used in the present invention. Preferred examples of DIR couplers which release a developing inhibitor are described in the patents cited in RD 17643, VII-F, JP-A-57-151944, 57-154234, 60-184248, 63-37346, and 63-37350, and U.S. Pat. Nos. 4,248,962, and 4,782,012.

Couplers capable of imagewise releasing a nucleating agent or a developing accelerator at the time of development preferably include those described in British Patents 2,097,140 and 2,131,188, and JP-A-59-157638 and JP-A-59-170840.

In addition to the foregoing couplers, the photographic material according to the present invention can further comprise competing couplers as described in U.S. Pat. No. 4,130,427, polyequivalent couplers as described in U.S. Pat. Nos. 4,283,472, 4,338,393, and 4,310,618, DIR redox compound- or DIR coupler-releasing couplers, or DIR coupler- or DIR redox-releasing redox compounds as described in JP-A-60-185950 and JP-A-62-24252, couplers capable of releasing a dye which returns to its original color after release as described in European Patents 173,302A and 313,308A, bleach accelerator-releasing couplers as described in RD. Nos. 11449 and 24241, and JP-A-61-201247, couplers capable of releasing a ligand as described in U.S. Pat. No. 4,555,477, couplers capable of releasing a leuco dye as described in JP-A-63-75747, and couplers capable of releasing a fluorescent dye as described in U.S. Pat. No. 4,774,181.

The incorporation of the couplers of the present invention in the light-sensitive material can be accomplished by any suitable known dispersion method.

Examples of high boiling solvents used in the oil-in-water dispersion process are described in U.S. Pat. No. 2,322,027.

Specific examples of high boiling organic solvents having a boiling point of 175 ° C. or higher at normal pressure which can be used in the oil-in-water dispersion process include phthalic esters (e.g., dibutyl phthalate, dicyclohexyl phthalate, di-2-ethylhexyl phthalate, decyl phthalate, bis(2,4-di-t-amylphenyl)phthalate, bis(2,4-di-t-amylphenyl) isophthalate, bis(1,1-diethylpropyl)phthalate), phosphoric or phosphonic esters (e.g., triphenyl phosphate, tricresyl phosphate, 2-ethylhexyl diphenyl phosphate, tricyclohexyl phosphate, tri-2-ethylhexyl phosphate, tridecyl phosphate, tributoxy ethyl phosphate, trichloropropyl phosphate, di-2-ethylhexyl phenyl phosphonate), benzoic esters (e.g., 2-ethylhexyl benzoate, dodecyl benzoate, 2-ethylhexyl p-hydroxybenzoate), amides (e.g., N,N-diethyldodecanamide, N,N-diethyllaurylamide, N-tetradecylpyrrolidone), alcohols or phenols (e.g., isostearyl alcohol, 2,4-di-tert-amylphenol), aliphatic carboxylic esters (e.g., bis(2-ethylhexyl)sebacate, dioctyl azerate, glycerol tributylate, isostearyl lactate, trioctyl citrate), aniline derivatives (e.g., N,N-dibutyl-2-butoxy-5-tert-octylaniline), and hydrocarbons (e.g., paraffin, dodecylbenzene, diisopropyl naphthalene). As an auxiliary solvent there can be used an organic solvent having a boiling point of about 30° C. or higher, preferably 50° C. to about 160° C. Typical examples of such an organic solvent include ethyl acetate, butyl acetate, ethyl propionate, methyl ethyl ketone, cyclohexanone, 2-ethoxyethyl acetate, and dimethylformamide.

The process and effects of latex dispersion methods and specific examples of latexes to be used in dipping are described in U.S. Pat. No. 4,199,363, West German Patent Application (OLS) 2,541,274, and 2,541,230.

These couplers may be emulsion-dispersed in an aqueous hydrophilic colloidal solution through impregnation in a loadable latex polymer (see, e.g., U.S. Pat. No. 4,203,716) in the presence or absence of the above mentioned high boiling organic solvent or solution in a water-insoluble or organic solvent-soluble polymer.

Preferably, a homopolymer or copolymer as disclosed in International Patent Application Disclosure WO88/00723, p. 12–30 may be used. In particular, the use of an acrylamide polymer is preferred in the light of the stability of the dye image.

The color light-sensitive material of the present invention preferably comprises various antiseptics or antifungal agents such as 1,2-benzisothiazoline-3-one, n-butyl-p-hydroxybenzoate, phenol, 4-chloro-3,5-dimethylphenol, 2-phenoxyethanol and 2-(4-thiazolyl)benzimidazole as described in JP-A-63-257747, JP-A-62-272248 and JP-A-1-80941.

The present invention is applicable to various types of color light-sensitive materials, particularly preferably to color negative films for common use or motion pictures, color reversal films for slide or television, color papers, color positive films and color reversal papers.

Suitable supports which can be used in the present invention are described in the above cited RD 17643 (page 28), and No. 18716 (right column on page 647 to left column on page 648).

In the present light-sensitive material, the total thickness of all the hydrophilic colloidal layers on the emulsion side is preferably in the range of 28 μm or less, more preferably 23 μm or less, further preferably 18 μm or less, particularly 16 μm or less. The film swelling $T_{\frac{1}{2}}$ is preferably in the range of 30 seconds or less, more preferably 20 seconds or less. In the present invention, the film thickness is determined after being stored at a temperature of 25° C. and a relative humidity of 55% for 2 days. The film swelling $T_{\frac{1}{2}}$ can be determined by a method known in the art, e.g., by means of a swellometer of the type as described in A. Green et al, *Photographic Science and Engineering*, vol. 19, No. 2, pp. 124–129. $T_{\frac{1}{2}}$ is defined as the time taken until half the saturated film thickness is reached wherein the saturated film thickness is 90% of the maximum swollen film thickness reached when the lightsensitive material is processed with a color developer at a temperature of 30° C. over 195 seconds.

The film swelling $T_{\frac{1}{2}}$ can be adjusted by adding a film hardener to the gelatin as a binder or altering the ageing conditions after coating. The percentage of swelling of the light-sensitive material is preferably in the range of 150 to 400%. The percentage of swelling can be calculated from the maximum swollen film thickness determined as described above in accordance with the equation: (maximum swollen film thickness-film thickness)-/film thickness.

The color photographic light-sensitive material according to the present invention can be developed in accordance with an ordinary method as described in RD Nos. 17643 (pp. 28–29), and 18716 (left column - right column on page 651).

The color developer to be used in the development of the present light-sensitive material is preferably an alkaline aqueous solution containing as a main component an aromatic primary amine color developing agent. Such a color developing agent can be an aminophenolic compound. In particular, p-phenylenediamine compounds are preferably used. Typical examples of such p-phenylenediamine compounds include 3-methyl-4-amino-N,N-diethylaniline, 3-methyl-4-amino-N-ethyl-N-β-hydroxyethylaniline, 3-methyl-4-amino-N-ethyl-N-β-methanesulfonamidoethylaniline, 3-methyl-4-amino-N-ethyl-N-β-methoxyethylaniline, and sulfates, hydrochlorides and p-toluenesulfonates thereof. Particularly preferred among these compounds is 3-methyl-4-amino-N-ethyl-N-β-hydroxyethylaniline sulfate. These compounds can be used in combinations of two or more depending on the purpose of the application.

The color developer normally contains a pH buffer such as a carbonate or phosphate of an alkaline metal or a development inhibitor or fog inhibitor such as a chloride, bromide, iodide, benzimidazole, benzothiazole or mercapto compound. If desired, the color developer may further contain various preservatives such as hydroxylamine, diethylhydroxylamine, sulfites, hydrazines (e.g., N,N-biscarboxymethylhydrazine), phenylsemicarbazides, triethanolamine and catecholsulfonic acids, organic solvents such as ethylene glycol and diethylene glycol, development accelerators such as benzyl alcohol, polyethylene glycol, quaternary ammonium salts, and amines, colorforming couplers, competing couplers, auxiliary developing agents such as 1-phenyl-3-pyrazolidone, viscosity-imparting agents, various chelating agents exemplified by aminopolycarboxylic acids, aminopolyphosphoric acids, alkylphosphonic acids, and phosphonocarboxylic acids, (e.g., ethylenediaminetetraacetic acid, nitrilotriacetic acid, diethylenetriaminepentaacetic acid, cyclohexanediaminetetraacetic acid, hydroxyethyliminoacetic acid, 1-hydroxyethylidene-1,1-diphosphonic acid, nitrilo-N,N,N-trimethylenephosphonic acid, ethylenediamine-N,N,N',N'-tetramethylenephosphonic acid, and ethylenediamine-di(o-hydroxyphenylacetic acid), and salts thereof).

Reversal processing is usually carried out by black-and-white development followed by color development. Black-and-white developers to be used can contain one or more known black-and-white developing agents, such as dihydroxybenzenes (e.g., hydroquinone), 3-pyrazolidones (e.g., 1-phenyl-3-pyrazolidone), and aminophenols (e.g., N-methyl-p-aminophenol).

The color developer or black-and-white developer usually has a pH of from 9 to 12. The replenishment rate of the developer is usually 3 l or less per $m^2$ of the light-sensitive material, depending on the type of the color photographic material to be processed. The replenishment rate may be reduced to 500 ml/$m^2$ or less by decreasing the bromide ion concentration in the replenisher. If the replenishment rate is reduced, the area of the processing tank in contact with air is preferably reduced to inhibit the evaporation and air oxidation of the processing solution.

The area of the photographic processing solution in contact with air in the processing tank can be represented by an opening value as defined as follows. That is, the opening value is obtained by dividing the area of processing solution in contact with air ($cm^2$) by the volume of processing solution ($cm^3$).

The opening value as defined above is preferably in the range of 0.1 or less, more preferably 0.001 to 0.05. Examples of methods for reducing the opening value include a method which comprises putting a cover such as floating lid on the surface of the processing solution in the processing tank, a method disclosed in JP-A-1-82033 utilizing a mobile lid, and a slit development method disclosed in JP-A-63-216050. The reduction of the opening value is preferably effected in both color development and black-and-white development steps as well as all the subsequent steps such as bleach, blix, fixing, rinse and stabilization. The replenishment rate can also be reduced by a means for suppressing accumulation of the bromide ion in the developing solution.

The color processing time is normally in the range of 2 to 5 minutes. The processing time can be further reduced by carrying out color development at an elevated temperature and a high pH value with a color developing solution containing a color developing agent in a high concentration.

The photographic emulsion layer which has been color-developed is normally subjected to bleach. Bleach may be effected simultaneously with fixation (i.e., blix), or these two steps may be carried out separately. For speeding up processing, bleach may be followed by blix. Further, any of an embodiment wherein two blix baths connected in series are used, an embodiment wherein blix is preceded by fixation, and an embodiment wherein blix is followed by bleach may be selected arbitrarily according to the purpose. Bleaching agents to be used include compounds of polyvalent metals, e.g., iron (III), peroxides, quinones, and nitro compounds. Typical examples of these bleaching agents include organic complex salts of iron (III), e.g., with aminopolycarboxylic acids such as ethylenediaminetetraacetic acid, diethylenetriaminepentaacetic acid, cyclohexanediaminetetraacetic acid, methyliminodiacetic acid, 1,3-diaminopropanetetraacetic acid, and glycol ether diaminetetraacetic acid, or citric acid, tartaric acid, malic acid, etc. Of these, aminopolycarboxylic acid-iron (III) complex salts such as (ethylenediaminetetraacetato)iron (III) complex salts and (1,3-diaminopropanetetraacetate)iron (III) complex salts are preferred to speed up processing and conserve the environment. In particular, aminopolycarboxylic acid-iron (III) complex salts are useful in both a bleaching solution and a blix solution. The pH value of a bleaching solution or blix solution comprising such an aminopolycarboxylic acid-iron complex salts is normally in the range of 4.0 to 8. For speeding up processing, the processing can be effected at an even lower pH value.

The bleaching bath, blix bath or a prebath thereof can contain, if desired, a bleaching accelerator. Examples of useful bleaching accelerators include the compounds containing a mercapto or disulfide group described in U.S. Pat. No. 3,893,858, West German Patents 1,290,812, and 2,059,988, JP-A-53-32736, 53-57831, 53-37418, 53-72623, 53-95630, 53-95631, 53-104232, 53-124424, 53-141623, and 53-28426, and Research Disclosure No. 17129 (July 1978), the thiazolidine derivatives described in JP-A-50-140129, the thiourea derivatives described in U.S. Pat. No. 3,706,561, JP-B-45-8506, JP-A-52-20832 and 53-32735, the iodides described in West German Patent 1,127,715 and JP-A-58-16235, the polyoxyethylene compounds described in West German Patents 966,410 and 2,748,430, the polyamine compounds described in JP-B-45-8836, the compounds described in JP-A-49-40943, JP-A-49-59644, JP-A-53-94927, JP-A-54-35727, JP-A-55-26506, and JP-A-58-163940, and bromine ions. Preferred among these compounds are those containing a mercapto or disulfide group because of their great acceleratory effect. In particular, the compounds disclosed in U.S. Pat. No. 3,893,858, West German Patent 1,290,812, and JP-A-53-95630 are preferred. The compounds disclosed in U.S. Pat. No. 4,552,834 are also preferred. These bleaching accelerators may be incorporated into the light-sensitive material. These bleaching accelerators are particularly effective for blix of color light-sensitive materials for picture taking.

The bleaching solution or blix solution preferably contains an organic acid besides the above mentioned compounds for the purpose of inhibiting bleach stain. A particularly preferred organic acid is a compound with an acid dissociation constant (pKa) of 2 to 5. In particular, acetic acid, propionic acid are preferred.

Examples of fixing agents to be contained in the fixing solution or blix solution include thiosulfates, thiocyanates, thioethers, thioureas, and a large amount of iodides. The thiosulfates are normally used. In particular, ammonium thiosulfate can be most widely used. Further, thiosulfates are preferably used in combination with thiocyanates, thioether compounds, thioureas, etc. The preservatives of the fixing or blix bath are preferably the sulfites, bisulfites, carbonyl bisulfite adducts or sulfinic acid compounds described in European Patent 294769A. The fixing solution or blix solution preferably contains aminopolycarboxylic acids or organic phosphonic chelating agents for the purpose of stabilizing the solution.

The total time required for the desilvering step is preferably as short as possible so long as no maldesilvering occurs. The desilvering time is preferably in the range of 1 to 3 minutes, more preferably 1 to 2 minutes. The processing temperature is in the range of 25° C. to 50° C., preferably 35° C. to 45° C. In the preferred temperature range, the desilvering rate can be improved and stain after processing can be effectively inhibited.

In the desilvering step, the agitation is preferably intensified as much as possible. Specific examples of such an agitation intensifying method include the method described in JP-A-183460 which comprises jetting the processing solution to the surface of the emulsion layer in the light-sensitive material, the method described in JP-A-62-183461 which comprises improving the agitating effect by a rotary means, the method which comprises improving the agitating effect by moving the light-sensitive material with the emulsion surface in contact with a wiper blade provided in the bath so that turbulence occurs on the emulsion surface, and the method which comprises increasing the total circulated amount of processing solution. Such an agitation improving method can be effectively applied to the bleaching, blix or fixing bath. The improvement in agitation effect can be considered to expedite the supply of the bleaching agent, fixing agent or the like into the emulsion film, resulting in an improvement in the desilvering rate. The above mentioned agitation improving means can work more effectively when a bleach accelerator is used, remarkably increasing the bleach acceleration effect and eliminating the inhibition of fixing by the bleach accelerator.

The automatic developing machine to be used in the processing of the light-sensitive material of the present invention is preferably equipped with a light-sensitive material conveying means as disclosed in JP-A-60-191257, JP-A-60-191258, and JP-A-60-191259. Such a conveying means can remarkably reduce the amount of the processing solution carried from a bath to the subsequent bath, greatly inhibiting deterioration of the properties of the processing solution. This effect is remarkable in reducing the processing time or the amount of replenisher required at each step.

It is usual that the thus desilvered silver halide color photographic materials of the invention are subjected to washing and/or stabilization. The quantity of water to be used in the washing can be selected from a broad range depending on the characteristics of the light-sensitive material (for example, the kind of couplers, etc.), the end use of the light-sensitive material, the temperature of the washing water, the number of washing tanks (number of stages), the replenishment system (e.g., counter-flow system or direct-flow system), and various other factors. Of these factors, the relationship between the number of washing tanks and the quantity of water in a multistage counter-flow system can be obtained according to the method described in *Journal of the Society of Motion Picture and Television Engineers*, vol. 64, pp. 248–253 (May 1955).

According to the multi-stage counter-flow system described in the above reference, although the requisite amount of water can be greatly reduced, bacteria would grow due to an increase of the retention time of the water in the tank, and floating masses of bacteria stick to the light-sensitive material. In the present invention, in order to cope with this problem, the method of reducing calcium and magnesium ion concentrations described in JP-A-62-288838 can be used very effectively. Further, it is also effective to use isothiazolone compounds or thiabenzazoles as described in JP-A-57-8542, chlorine type bactericides, e.g., chlorinated sodium isocyanurate, benzotriazole, and bactericides described in Hiroshi Horiguchi, *Bokinbobaizai no kagaku* (1986); Eisei Gijutsu Gakkai (ed.), *Biseibutsu no mekkin, sakkin, bobigijutsu* (1982); and Nippon Bokin Bobi Gakkai (ed.), *Bokin bobizai jiten* (1986).

The washing water has a pH value of from 4 to 9, preferably from 5 to 8. The temperature of the water and the washing time can be selected from broad ranges depending on the characteristics and end use of the light-sensitive material, but usually ranges from 15° to 45° C. in temperature and from 20 seconds to 10 minutes in time, preferably from 25° to 40° C. in temperature and from 30 seconds to 5 minutes in time. The light-sensitive material of the invention may be directly processed with a stabilizer in place of the washing step. For the stabilization, any of the known techniques described in JP-A-57-8543, 58-14834, and 60-220345 can be used.

The aforesaid washing step may be followed by stabilization in some cases. An example is a stabilizing bath containing a dye stabilizer and a surface active agent as is used as a final bath for color light-sensitive materials for picture taking. Examples of such a dye stabilizer include aldehydes such as formaldehyde and glutaraldehyde, N-methylol compounds, hexamethylenetetramine, and aldehyde-bisulfite adducts.

This stabilizing bath may also contain various chelating agents or antifungal agents.

The overflow accompanying replenishment of the washing bath and/or stabilizing bath can be reused in other steps such as desilvering.

In the processing using an automatic developing machine, if the various processing solutions are concentrated due to evaporation, water is preferably added to correct the concentration.

The silver halide color light-sensitive material of the present in invention may contain a color developing agent for the purpose of simplifying and expediting processing. Such a color developing agent is preferably used in the form of various precursors. Examples of such precursors include the indoaniline compounds described in U.S. Pat. No. 3,342,597, the Schiff's base type compounds described in U.S. Pat. No. 3,342,599 and Research Disclosure Nos. 14,850 and 15,159, and the aldol compounds described in Research Disclosure No. 13,924, the metal complexes as described in U.S. Pat. No. 3,719,492, and the urethane compounds described in JP-A-53-135628.

The silver halide color light-sensitive material of the present invention may optionally comprise various 1-phenyl-3-pyrazolidones for the purpose of accelerating color development. Typical examples of such compounds are described in JP-A-56-64339, JP-A-57-144547, and JP-A-58-115438.

In the present invention, the various processing solutions are used at a temperature of 10° C. to 50° C. The standard temperature range is normally from 33° C. to 38° C. However, a higher temperature range can be used to accelerate processing, thereby reducing the processing time. On the contrary, a lower temperature range can be us used to improve the picture quality or the stability of the processing solutions.

The compound of general formula (1) can also be used in heat-developable light-sensitive materials such as those disclosed in U.S. Pat. Nos. 4,463,079, 4,474,867, 4,478,927, 4,507,380, 4,500,626, and 4,483,914, JP-A-58-149046, 58-149047, 59-152440, 59-154445, 59-165054, 59-180548, 59-168439, 59-174832, 59-174833, 59-174834, 59-174835, 61-232451, 62-65038, 62-253159, 63-316848, and 64-13546, and European Patents 210,660A2 and 220,746A2.

The present invention will be further described in the following examples, but the present invention should not be construed as being limited thereto.

EXAMPLE 1

Preparation of 1st Light-Sensitive Emulsion Layer

Preparation of Light-Sensitive Emulsion A

A 0.37M aqueous solution of silver nitrate and an aqueous solution of halogen salts containing $(NH_4)_3RhCl_6$ in an amount of $1\times10^{-7}$ mol per mol of silver, $K_3IrCl_6$ in an amount of $5\times10^{-7}$ mol per mol of silver, 0.11M potassium bromide and 0.27M sodium chloride were added to an aqueous solution of gelatin containing sodium chloride and 1,3-dimethyl-2-imidazolidinethione. The combination was stirred at a temperature of 45° C. for 12 minutes in a double jet process to prepare silver bromochloride grains having an average grain size of 0.20 μm and a silver chloride content of 70 mol %. Thus, nuclei were formed.

Then, a 0.63M aqueous solution of silver nitrate and an aqueous solution of halogen salts containing 0.19M potassium bromide and 0.47M sodium chloride were similarly added to the system in 20 minutes in a double jet process. A solution containing $1\times10^{-3}$ mol of potassium iodide was added to the system to effect conversion. The system was then washed with water by an ordinary flocculation method. Forty g of gelatin was added to the system. The system was then adjusted to a pH value of 6.5 and a pAg value of 7.5. Sodium thiosulfate, chloroauric acid and sodium benzenethiosulfonate were then added to the system in amounts of 5 mg, 8 mg and 7 mg per mol of silver, respectively. The system was heated to a temperature of 60° C. for 45 minutes so that it was chemically sensitized. One hundred and fifty mg of 6-methyl-4-hydroxy-1,-3,3a,7-tetrazaindene, Proxel (trade name of a product of ICI Co., Ltd.) and phenoxy ethanol were added to the system as stabilizers. As a result, an emulsion of cubic silver bromochloride grains having an average size of 0.28 μm and a silver chloride content of 70 mol % was obtained (coefficient of variation: 9%).

Coating of 1st Light-Sensitive Emulsion Layer

The emulsion thus prepared was then divided into several batches. To each of these batches were added 5-[3-(4-sulfobutyl)-5-chloro-2-oxazolidilidene]-1-hydroxyethyl-3-(2-pyridyl)-2-thiohydantoin in an amount of $1\times10^{-3}$ mol per mol of silver, 1-phenyl-5-mercaptotetrazole in an amount of $2\times10^{-4}$ mol per mol of silver, Compound (a) of the following structural formula as a short wave cyanine dye in an amount of $5\times10^{-4}$ mol per mol of silver, 200 mg/m$^2$ of Compound (b) as a polymer, 50 mg/m$^2$ of hydroquinone, 200 mg m$^2$ of a polyethylene dispersion, 200 mg/m$^2$ of 1,3-bisvinyl-sulfonyl-2-propanol as a film hardener, and the following Hydrazine Derivative (c) as a nucleating agent. These coating solutions were each coated on a support in such an amount that the coated amounts of silver and gelatin reached 3.6 g/m$^2$ and 2.0 g/m$^2$, respectively.

Compound (a)

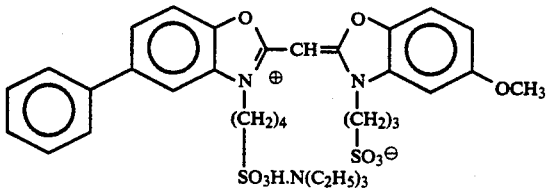

Compound (b)

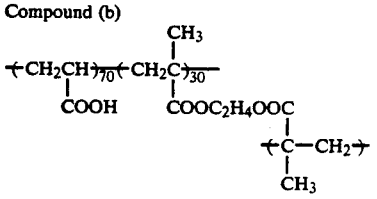

Hydrazine Derivative (c)

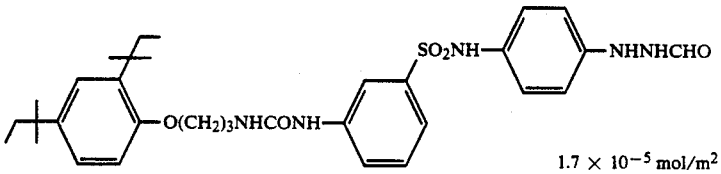

$1.7 \times 10^{-5}$ mol/m$^2$ (Coating of interlayer)

| | |
|---|---|
| Gelatin | 1.0 g/m$^2$ |
| 1,3-Bisvinylsulfonyl-2-propanol | 4.0 wt. % based on gelatin |

Preparation of Light-Sensitive Emulsion B

A 1.0M aqueous solution of silver nitrate and an aqueous solution of halogen salts containing $(NH_4)_3RhCl_6$ in an amount of $3\times10^{-7}$ mol per mol of silver, 0.3M potassium bromide and 0.74M sodium chloride were added to an aqueous solution of gelatin containing sodium chloride and 1,3-dimethyl-2-imidazolidinethione. The combination was stirred at a temperature of 45° C. in 30 minutes in a double jet process to prepare silver bromochloride grains having an average grain size of 0.28 μm and a silver chloride content of 70 mol %. The system was then washed with water by an ordinary flocculation method. Forty g of gelatin was added to the system. The system was then adjusted to a pH value of 6.5 and a pAg value of 7.5. Sodium thiosulfate and chloroauric acid were then added to the system in amounts of 5 mg and 8 mg per mol of silver, respectively. The system was heated to a temperature of 60° C. for 60 minutes so that it was chemically sensitized. One hundred and fifty mg of 1,3,3a,7-tetrazaindene was added to the system as stabilizer. As a result, an emulsion of cubic silver bromochloride grains having an average size of 0.28 μm and a silver chloride content of 70 mol % was obtained (coefficient of variation: 10%).

Coating of 2nd Light-Sensitive Emulsion Layer

Light-Sensitive Emulsion B was re-dissolved. To the emulsion were added at a temperature of 40° C. 5-[3-(4-sulfobutyl)-5-chloro-2-oxazolidilidene]-1-hydroxyethyl-3-(2-pyridyl)-2-thiohydantoin in an amount of $1\times10^{-3}$ mol per mol of silver, a solution of potassium iodide in an amount of $1.0\times10^{-3}$ mol per mol of silver, 1-phenyl-5-mercaptotetrazole in an amount of $2\times10^{-4}$ mol per mol of silver, 50 mg/m$^2$ of a polyethylacrylate dispersion, 1,3-bisvinylsulfonyl-2-propanol as a film hardener in an amount of 4.0 wt. % based on gelatin, and redox compounds of genral formula (1) of the present invention and comparative redox compounds as set forth in Table 1 in an amount of $5.8\times10^{-5}$ mol/m$^2$. These coating solutions were each coated on a support in such an amount that the coated amount of silver and gelatin reached 0.3 g/m$^2$ and 0.4 g/m$^2$, respectively.

Coating of protective layer

On the 2nd light-sensitive emulsion layer were coated 0.5 g/m$^2$ of gelatin and 0.3 g/m$^2$ of polymethyl methacrylate grains (average grain diamter: 2.5 μm) with the following surface active agents to provide a protective layer.

Surface active agents

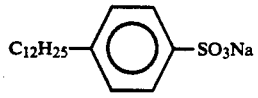

37 mg/m$^2$

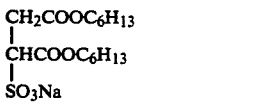

37 mg/m$^2$

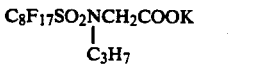

2.5 mg/m$^2$

A back layer and a back protective layer with the following formulations were prepared.

[Back layer]

-continued

| | |
|---|---|
| Gelatin | 3 g/m² |
| Latex (polyethylene acrylate) | 2 g/m² |
| Surface active agent (sodium p-dodecylbenzenesulfonate) | 40 mg/m² |

Gelatin hardener

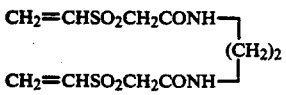

110 mg/m²

Dye (mixture of Dye [a], Dye [b] and Dye [c])

| | |
|---|---|
| Dye [a] | 50 mg/m² |
| Dye [b] | 100 mg/m² |
| Dye [c] | 50 mg/m² |

Dye [a]

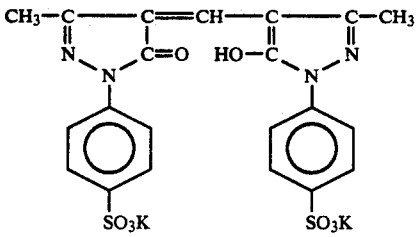

Dye [b]

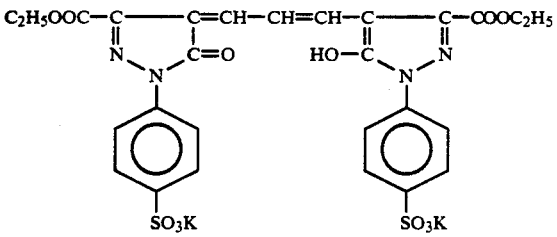

Dye [c]

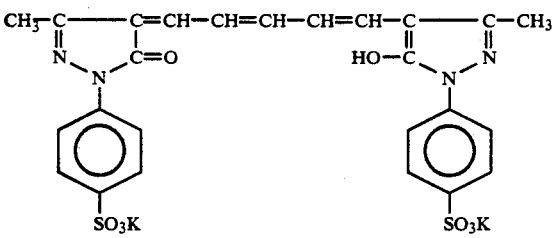

[Back protective layer]

| | |
|---|---|
| Gelatin | 0.8 g/m² |
| Finely divided polymethyl methacrylate grains (average grain diameter: 4.5μ) | 30 mg/m² |
| Sodium dihexyl-α-sulfosuccinate | 15 mg/m² |
| Sodium dodecylbenzenesulfonate | 15 mg/m² |
| Sodium acetate | 40 mg/m² |
| Fluorine surface active agent | 5 mg/m² |

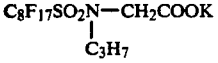

On a 100-μm thick polyester film was coated the 1st Light-Sensitive Emulsion Layer as a lowermost layer. On the lowermost layer was then coated the 2nd Light-Sensitive Emulsion layer containing a redox compound with an interlayer interposed therebetween. On the 2nd Light-Sensitive Emulsion layer was simutaneously coated the protective layer to prepare samples as set forth in Table 1.

The samples set forth in Table 1 were exposed to light from a tungsten lamp with a color temperature of 3,200° K. through an optical wedge and a contact screen (Type 150L chain dot, produced by Fuji Photo Film Co., Ltd.), developed with the following developer A at a temperature of 34° C. for 30 seconds, fixed, rinsed, and then dried.

| Developer A | |
|---|---|
| Hydroquinone | 50.0 g |
| N-methyl-p-aminophenol | 0.3 g |
| Sodium hydroxide | 18.0 g |
| 5-Sulfosalicylic acid | 55.0 g |
| Potassium sulfite | 24.0 g |
| Disodium ethylenediamine-tetraacetate | 1.0 g |
| Potassium bromide | 10.0 g |
| 5-Methyl benzotriazole | 0.4 g |
| 2-Mercaptobenzimidazole-5-sulfonic acid | 0.3 g |
| Sodium 3-(5-mercaptotetrazole) benzenesulfonate | 0.2 g |
| N-n-butyldiethanolamine | 15.0 g |
| Sodium toluenesulfonate | 8.0 g |
| Water to make | 1 l |
| pH (adjusted with potassium hydroxide) | 11.6 |

Dot gradation is represented by the following equation:

Dot gradation = Exposure giving 95% dot area ratio (log E 95%) — Exposure giving 5% dot area ratio (log E 5%)

The dot quality was visually evaluated in five steps. In the 5-step evaluation, Step "5" is excellent, and Step "1" is poor. Steps "5" and "4" are practicable as plate-making dot precursor. Step "3" is the lowest practicable level. Steps "2" and "1" are impracticable levels.

The results are set forth in Table 1.

TABLE 1

| | Sample No. | Redox Compound | Dot gradation (Δ log E) | Dot quality |
|---|---|---|---|---|
| 1 | Comparative Sample 1-a | — | 1.18 | 3 |
| 2 | Comparative Sample 1-b | Comparative Compound A | 1.25 | 3 |
| 3 | Comparative Sample 1-c | Comparative Compound B | 1.20 | 3 |
| 4 | Comparative Sample 1-d | Comparative Compound C | 1.19 | 3 |
| 5 | Comparative Sample 1-e | Comparative Compound D | 1.22 | 3 |
| 6 | Comparative Sample 1-f | Comparative Compound E | 1.31 | 4 |
| 7 | Sample 1-1 | (1-1) | 1.39 | 5 |
| 8 | Sample 1-2 | (1-2) | 1.35 | 5 |
| 9 | Sample 1-3 | (1-3) | 1.38 | 5 |
| 10 | Sample 1-4 | (1-9) | 1.32 | 5 |
| 11 | Sample 1-5 | (1-10) | 1.41 | 5 |
| 12 | Sample 1-6 | (1-11) | 1.36 | 5 |
| 13 | Sample 1-7 | (1-17) | 1.38 | 5 |
| 14 | Sample 1-8 | (1-18) | 1.34 | 5 |
| 15 | Sample 1-9 | (1-12) | 1.33 | 5 |

The structural formula of the comparative compounds are set forth below. Comparative Compound A (Compound 28 described in JP-A-61-213847)

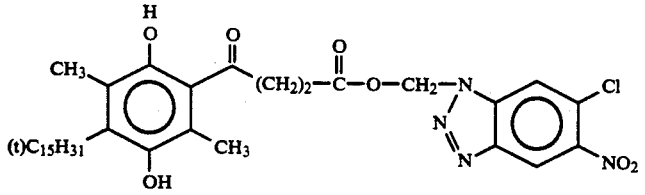

Comparative Compound B (Compound 2 described in JP-A-62-260153)

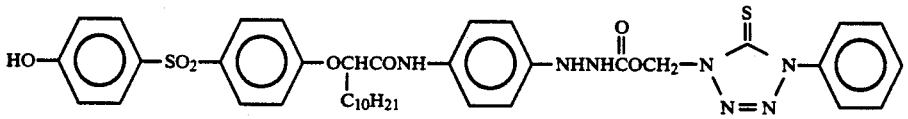

Comparative Compound C (Compound 10 described in JP-A-64-88451)

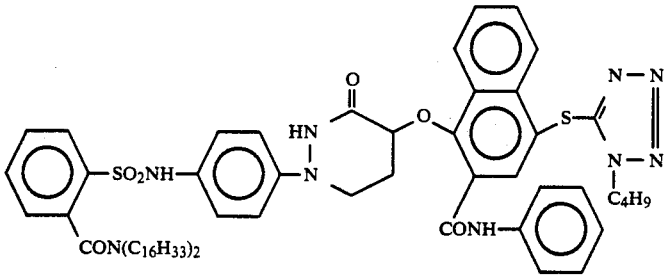

Comparative Compound D (Compound 13 described in JP-A-64-72140)

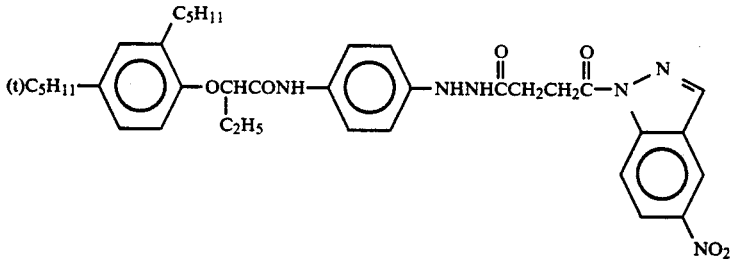

Comparative Compound E (Compound described in JP-A-2-62337)

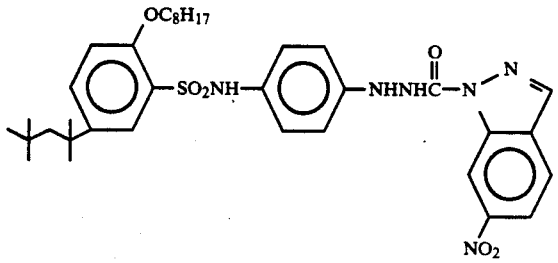

The results set forth in Table 1 show that Comparative Sample 1-f and all the samples of the present invention exhibited a high dot gradation and a high dot quality.

EXAMPLE 2

Light-sensitive material samples were prepared in the same manner as in Example 1 except that the following alterations were made.

1st Light-Sensitive Emulsion Layer

Hydrazine Compound (2-21) was incorporated into the system as a nucleating agent in an amount of $1.0\times10^{-5}$ mol/m$^2$.

Interlayer 1.0 g/m$^2$ of gelatin, 15 mg/m$^2$ of the compound of the following chemical structure, and 1,3-bisvinylsulfonyl-2-propanol in an amount of 2.0 wt. % based on gelatin were incorporated into the system.

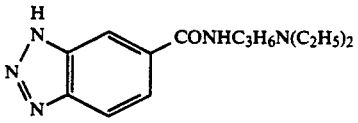

2nd Light-Sensitive Emulsion Layer

Comparative redox compounds and redox compounds of formula (1) as set forth in Table 2 were incorporated into the system in an amount of $9.5\times10^{-5}$ mol/m$^2$, respectively. These coating solutions were each coated on the support in such an amount that the coated amount of silver and gelatin reached 0.4 g/m$^2$ and 0.5 g/m$^2$, respectively.

The samples thus obtained were evaluated for properties after processing with the following developer B in the same manner as in Example 1.

| Developer B | |
|---|---|
| Hydroquinone | 30.0 g |
| N-methyl-p-aminophenol | 0.3 g |
| Sodium hydroxide | 10.0 g |
| Potassium sulfite | 60.0 g |
| Disodium ethylenediamine-tetraacetate | 1.0 g |
| Potassium bromide | 10.0 g |
| 5-Methylbenzotriazole | 0.4 g |
| 2-Mercaptobenzimidazole-5-sulfonic acid | 0.3 g |
| Sodium 3-(5-mercaptotetrazole) benzenesulfonate | 0.2 g |
| Sodium toluenesulfonate | 8.0 g |
| Water to make | 1 l |
| pH (adjusted with potassium hydroxide) | 10.5 |

The results are set forth in Table 2.

The samples of the present invention exhibited a wide dot gradation and a high dot quality.

TABLE 2

| | Sample No. | Redox Compound | Dot gradation (Δ log E) | Dot quality |
|---|---|---|---|---|
| 1 | Comparative Sample 2-a | — | 1.20 | 3 |
| 2 | Comparative Sample 2-b | Comparative Compound A | 1.21 | 3 |
| 3 | Comparative Sample 2-c | Comparative Compound B | 1.20 | 3 |
| 4 | Comparative Sample 2-d | Comparative Compound C | 1.20 | 3 |
| 5 | Comparative Sample 2-e | Comparative Compound D | 1.21 | 3 |
| 6 | Comparative Sample 2-f | Comparative Compound E | 1.27 | 4 |
| 7 | Sample 2-1 | (1-1) | 1.35 | 5 |
| 8 | Sample 2-2 | (1-2) | 1.30 | 5 |
| 9 | Sample 2-3 | (1-3) | 1.35 | 5 |
| 10 | Sample 2-4 | (1-9) | 1.29 | 5 |
| 11 | Sample 2-5 | (1-10) | 1.37 | 5 |
| 12 | Sample 2-6 | (1-11) | 1.31 | 5 |
| 13 | Sample 2-7 | (1-17) | 1.32 | 5 |
| 14 | Sample 2-8 | (1-18) | 1.30 | 5 |
| 15 | Sample 2-9 | (1-12) | 1.29 | 5 |

EXAMPLE 3

Preparation of Light-Sensitive Emulsion C

An aqueous solution of silver nitrate and an aqueous solution of sodium chloride were simultaneously added to an aqueous solution of gelatin which had been kept at a temperature of 50° C. in the presence of $(NH_4)_3RhCl_6$ in an amount of $5.0\times10^{-6}$ mol per mol of silver. Soluble salts were removed from the system by a method well known in the art. Gelatin was then added to the system. As a stabilizer, 6-methyl-4-hydroxy-1,3,-3a,7-tetrazaindene was added to the system without chemical ripening. As a result, a monodisperse emulsion of cubic crystals having an average grain size of 0.15 μm was obtained.

Coating of Light-Sensitive Emulsion Layer

1st layer

To the Light-Sensitive Emulsion C were added 75 mg/m$^2$ of Hydrazine Compound (2-8), $5\times10^{-3}$ mol/Ag mol of 5-methylbenzotriazole, a polyethyle acrylate latex in an amount of 30 wt. % based on gelatin, and 1,3- bisvinylsulfonyl-2-propanol in an amount of 2.0 wt. % based on gelatin. The coating solution thus obtained was coated on a support in such an amount that the coated amount of silver and gelatin reached 3.5 g/m$^2$ and 2 g/m$^2$, respectively.

2nd layer

Gelatin (1.0 g/m$^2$)

3rd layer

To Light-Sensitive Emulsion C were added $5\times10^{-3}$ mol/Ag mol of 5-methylbenzotriazole, a polyethyl acrylate latex in an amount of 30 wt. % based on gelatin, 1,3-bisvinylsulfonyl-2-propanol in an amount of 2.0 wt. % based on gelatin, and redox compounds of general formula (1) as set forth in Table 3. The coating solutions thus obtained were each coated on the 2nd layer in such an amount that the coated amount of silver and gelatin reached 0.4 g/m$^2$ and 0.5 g/m$^2$, respectively.

4th layer (protective layer)

A protective layer containing 1.5 g/m$^2$ of gelatin, 0.3 g/m$^2$ of a particulate polymethyl methacrylate (average grain size: 2.5 μm) as a matting agent, a surface active agent having the following chemical structure as a coating aid, the stabilizer shown below, and an ultraviolet absorbent was coated on the 3rd layer, and then dried.

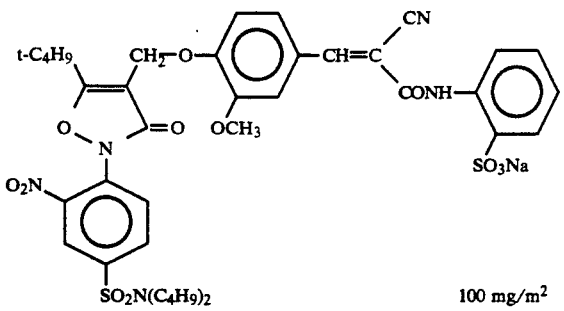

100 mg/m$^2$

Stabilizer

Thioctic acid 2.1 mg/m$^2$

Surface Active Agent

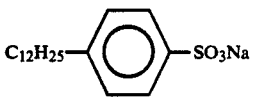

37 mg/m$^2$

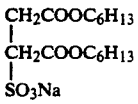

37 mg/m$^2$

-continued $C_8F_{17}SO_2N(C_3H_7)CH_2COOK$ 2.5 mg/m²

These samples were each imagewise exposed to light through an original as shown in FIG. 1 in JP-A-1-240966 in a daylight printer p-607 produced by Dainippon Screen Mfg. Co., Ltd., developed with Developer A at a temperature of 38° C. for 20 seconds, fixed, rinsed, dried, and then evaluated for extract letter image quality.

Extract letter image quality 5 is a very good and enables reproduction of 30-μm wide letters when exposure is effected through an original as shown in FIG. 1 in JP-A-1-240966 in such a manner that 50% dot area turns out 50% dot area on a reversing light-sensitive material. On the contrary, extract letter image quality 1 is a poor and can only reproduce letters having a width of 150 μm or more under the same exposure conditions as the extract letter image quality. Between extract letter image quality 5 and extract letter image quality 1 are provided extract letter image qualities 4, 3 and 2. Extract letter image quality 3 or higher are practicable levels.

TABLE 3

| | | Redox compound | | |
|---|---|---|---|---|
| | Sample No. | Kind | Added amount (mol/m²) | Extract letter image quality |
| 1 | Comparative Sample 3-a | — | — | 2 |
| 2 | Comparative Sample 3-b | Comparative Compound A | $0.45 \times 10^{-4}$ | 3 |
| 3 | Sample 3-1 | (1-1) | $0.45 \times 10^{-4}$ | 5 |
| 4 | Sample 3-2 | (1-2) | $0.45 \times 10^{-4}$ | 5 |
| 5 | Sample 3-3 | (1-3) | $0.45 \times 10^{-4}$ | 5 |
| 6 | Sample 3-4 | (1-8) | $0.45 \times 10^{-4}$ | 4 |
| 7 | Sample 3-5 | (1-10) | $0.45 \times 10^{-4}$ | 5 |
| 8 | Sample 3-6 | (1-11) | $0.45 \times 10^{-4}$ | 5 |
| 9 | Sample 3-7 | (1-12) | $0.45 \times 10^{-4}$ | 4 |

The results set forth in Table 3 show that the samples of the present invention exhibit an excellent extract letter image quality.

In accordance with the present invention, the use of a compound of general formula (1) can provide a silver halide photographic material which exhibits an excellent dot gradation, dot quality and extract letter image quality.

While the invention has been described in detail and with reference to specific embodiments thereof, it will be apparent to one skilled in the art that various changes and modifications can be made therein without departing from the spirit and scope thereof.

What is claimed is:

1. A silver halide photographic material which comprises at least one light-sensitive silver halide emulsion layer on a support, said light-sensitive layer or another hydrophilic colloidal layer containing a compound represented by the following general formula (1):

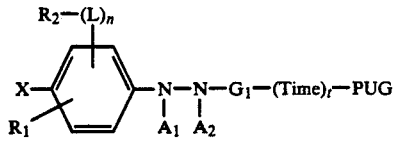

(1)

wherein X represents a hydroxy, amino or sulfonamide; $A_1$ and $A_2$ each represents a hydrogen atom, an alkylsulfonyl group, an arylsulfonyl group or an acyl group, with the proviso that at least one of $A_1$ and $A_2$ is a hydrogen atom; $G_1$ represents —CO—, —COCO—, —CS—, —C(=$NG_2R_3$)—, —SO—, —$SO_2$— or —P(O)($G_2R_3$)—; $G_2$ represents a mere bond, —O—, —S— or —N($R_3$)—; $R_1$ represents a hydrogen atom, an amino group, a sulfonamide group, a halogen atom, a hydroxyl group, an alkoxy group or an alkyl group; L represents a divalent linking group; n represents an integer 0 or 1; $R_2$ represents an aliphatic, aromatic or heterocyclic group; Time represents a divalent linking group; t represents an integer 0 or 1; $R_3$ represents a hydrogen atom or a group recited in the definition of $R_2$; and PUG represents a photographically useful group.

2. A silver halide photographic material as claimed in claim 1, further comprising a light-sensitive silver halide emulsion layer or a hydrophilic colloid layer adjacent thereto which contains a nucleating agent and which is different from said light-sensitive or other hydrophilic colloid layer which contains the compound represented by formula (1).

3. A silver halide photographic material as claimed in claim 2, wherein said layer which contains the nucleating agent is located between the support and said layer which contains the compound according to formula (1).

4. A silver halide photographic material as claimed in claim 2, wherein said layer which contains the compound according to formula (1) is located between the support and said layer which contains the nucleating agent.

5. A silver halide photographic material as claimed in claim 1, wherein PUG is a development inhibitor.

6. A silver halide photographic material as claimed in claim 5, wherein the development inhibitor contains a hetero atom through which it is bonded to Time when t=1 or to $G_1$ when t=0.

7. A silver halide photographic material as claimed in claim 5, wherein the development inhibitor inhibits nucleation infectious development.

8. A silver halide photographic material as claimed in claim 5, wherein PUG is a nucleation development inhibitor which contains a nitro group or has a pyridine skeleton.

* * * * *